US007966684B2

(12) United States Patent
Wright et al.

(10) Patent No.: US 7,966,684 B2
(45) **Date of Patent: *Jun. 28, 2011**

(54) METHODS AND APPARATUS TO ACCELERATE THE DRYING OF AQUEOUS WORKING FLUIDS

(75) Inventors: Tremitchell L. Wright, Elkhart, IN (US); Joel A. Luckman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1409 days.

This patent is subject to a terminal disclaimer.

(21) Appl. No.: 11/135,570

(22) Filed: May 23, 2005

(65) Prior Publication Data

US 2006/0260065 A1 Nov. 23, 2006

(51) Int. Cl.
*D06F 33/00* (2006.01)
*D06L 1/02* (2006.01)

(52) U.S. Cl. ..... 8/158

(58) Field of Classification Search ..... 8/158
See application file for complete search history.

(56) References Cited

U.S. PATENT DOCUMENTS

| | | | | |
|---|---|---|---|---|
| 2,107,227 | A | | 2/1938 | Woodin |
| D120,681 | S | | 5/1940 | Sutton |
| 2,629,242 | A | | 2/1953 | Hallander |
| 2,940,287 | A | | 6/1960 | Henderson |
| 2,987,902 | A | | 6/1961 | Mack |
| 3,085,415 | A | | 4/1963 | Gosnell |
| 3,103,112 | A | | 9/1963 | Behrens et al. |
| 3,114,919 | A | | 12/1963 | Kenreich |
| 3,125,106 | A | | 3/1964 | Brucken et al. |
| 3,163,028 | A | | 12/1964 | De Pas et al. |
| 3,410,188 | A | | 12/1964 | DePasLaidA et al. |
| 3,225,572 | A | | 12/1965 | Robbins et al. |
| 3,232,335 | A | | 2/1966 | Kalbfleisch |
| 3,234,660 | A | | 2/1966 | Williams et al. |
| 3,246,493 | A | | 4/1966 | Oles |
| 3,266,166 | A | | 8/1966 | Heinrich |
| 3,269,539 | A | | 8/1966 | Brucken et al. |
| 3,386,796 | A | | 6/1968 | Videen |
| 3,402,576 | A | | 9/1968 | Krupsky |
| 3,408,860 | A | * | 11/1968 | Knieriem et al. ..... 73/73 |
| 3,410,118 | A | | 11/1968 | Dickey |
| 3,423,311 | A | | 1/1969 | Hetherinton et al. |
| 3,477,259 | A | | 11/1969 | Barnish et al. |

(Continued)

FOREIGN PATENT DOCUMENTS

DE 4319177 2/1994

(Continued)

OTHER PUBLICATIONS

U.S. Appl. No. 11/135,146, filed May 23, 2005, Luckman et al.

(Continued)

*Primary Examiner* — Michael Barr
*Assistant Examiner* — Jason P Riggleman
(74) *Attorney, Agent, or Firm* — Clifton G. Green

(57) ABSTRACT

A method and apparatus for drying a fabric load which has been wetted with a working fluid including the steps of flowing drying gas through a container holding the fabric load, sensing the non-aqueous working fluid concentration and the aqueous working fluid concentration in the wash liquor or in the headspace above the fabric within the container and controlling drying in response to the sensed working fluid concentration.

20 Claims, 12 Drawing Sheets

U.S. PATENT DOCUMENTS

| | | | | |
|---|---|---|---|---|
| 3,583,181 | A | | 6/1971 | Brillet |
| 3,674,650 | A | | 7/1972 | Fine |
| 3,683,651 | A | | 8/1972 | Mazza |
| 3,691,649 | A | | 9/1972 | Pigors |
| 3,733,267 | A | | 5/1973 | Haase |
| 3,739,496 | A | | 6/1973 | Buckley et al. |
| 3,765,580 | A | | 10/1973 | Wilsker et al. |
| 3,809,924 | A | | 5/1974 | Grunow et al. |
| 3,817,381 | A | | 6/1974 | Heskett et al. |
| 3,861,179 | A | | 1/1975 | Orchard |
| 3,915,808 | A | | 10/1975 | Wilcox |
| 3,926,552 | A | | 12/1975 | Bruckner |
| 3,930,998 | A | | 1/1976 | Knopp et al. |
| 4,004,048 | A | | 1/1977 | Jackson |
| 4,032,927 | A | | 6/1977 | Goshima |
| 4,042,498 | A | | 8/1977 | Kennedy |
| 4,045,174 | A | | 8/1977 | Fuhring et al. |
| 4,046,700 | A | | 9/1977 | Glover |
| 4,121,009 | A | | 10/1978 | Chakrabarti |
| 4,153,590 | A | | 5/1979 | Mueller |
| 4,154,003 | A | | 5/1979 | Muller |
| 4,169,856 | A | | 10/1979 | Cocuzza et al. |
| 4,184,950 | A | | 1/1980 | Bixby |
| 4,186,047 | A | | 1/1980 | Salmon |
| 4,223,029 | A | * | 9/1980 | Mahler et al. ..... 427/242 |
| 4,235,600 | A | | 11/1980 | Capella |
| 4,247,330 | A | | 1/1981 | Sanders, Jr. |
| 4,252,546 | A | | 2/1981 | Krugmann |
| 4,331,525 | A | | 5/1982 | Huba et al. |
| 4,345,297 | A | | 8/1982 | Check |
| 4,388,437 | A | | 6/1983 | Ona |
| 4,395,488 | A | | 7/1983 | Rowe |
| 4,420,398 | A | | 12/1983 | Castino |
| 4,421,794 | A | | 12/1983 | Kinsley, Jr. |
| 4,434,196 | A | | 2/1984 | Robinson et al. |
| 4,444,625 | A | | 4/1984 | Smith |
| 4,457,858 | A | | 7/1984 | Saran |
| 4,499,621 | A | | 2/1985 | Gasser |
| 4,513,590 | A | | 4/1985 | Fine |
| 4,539,093 | A | | 9/1985 | Friedman et al. |
| 4,595,506 | A | | 6/1986 | Kneer |
| 4,601,181 | A | | 7/1986 | Privat |
| 4,610,785 | A | | 9/1986 | Russell |
| 4,621,438 | A | | 11/1986 | Lanciaux |
| 4,622,039 | A | | 11/1986 | Merenda |
| 4,625,432 | A | | 12/1986 | Baltes |
| 4,636,328 | A | | 1/1987 | Flynn et al. |
| 4,664,754 | A | | 5/1987 | Caputi et al. |
| 4,665,929 | A | | 5/1987 | Helm |
| 4,678,587 | A | | 7/1987 | Voinche et al. |
| 4,682,424 | A | | 7/1987 | Irving |
| 4,685,930 | A | | 8/1987 | Kasprzak |
| 4,708,775 | A | | 11/1987 | McGregor et al. |
| 4,708,807 | A | | 11/1987 | Kemerer |
| 4,755,261 | A | | 7/1988 | McCord et al. |
| 4,761,209 | A | | 8/1988 | Bonaventura et al. |
| 4,767,537 | A | | 8/1988 | Davis |
| 4,769,921 | A | | 9/1988 | Kabakov |
| 4,790,910 | A | | 12/1988 | Havlik |
| 4,802,253 | A | | 2/1989 | Hagiwara |
| 4,808,319 | A | | 2/1989 | McNally et al. |
| 4,818,297 | A | | 4/1989 | Holzmiiller et al. |
| 4,830,710 | A | | 5/1989 | Thompson |
| 4,834,003 | A | | 5/1989 | Reischl et al. |
| 4,851,123 | A | | 7/1989 | Kmishra |
| 4,857,150 | A | | 8/1989 | Rival |
| 4,869,872 | A | | 9/1989 | Baltes |
| 4,879,888 | A | | 11/1989 | Suissa |
| 4,880,533 | A | | 11/1989 | Hondulas |
| 4,904,390 | A | | 2/1990 | Schweighofer et al. |
| 4,911,761 | A | | 3/1990 | McConnell |
| 4,912,793 | A | | 4/1990 | Hagiwara |
| 4,919,839 | A | | 4/1990 | Durbut |
| 4,947,983 | A | | 8/1990 | Jost |
| 4,961,753 | A | | 10/1990 | Donkers et al. |
| 4,980,030 | A | | 12/1990 | Johnson et al. |
| 4,984,318 | A | | 1/1991 | Coindreau-Palau |
| 4,999,398 | A | | 3/1991 | Graiver et al. |
| 5,004,000 | A | | 4/1991 | Berruex |
| 5,028,326 | A | | 7/1991 | Littler et al. |
| 5,043,075 | A | | 8/1991 | Dietmar et al. |
| 5,050,259 | A | | 9/1991 | Tsubaki |
| 5,054,210 | A | | 10/1991 | Schumacher |
| 5,056,174 | A | | 10/1991 | Hagiwara |
| 5,082,503 | A | | 1/1992 | Slugs |
| 5,091,105 | A | | 2/1992 | Madore et al. |
| 5,093,031 | A | | 3/1992 | Login et al. |
| 5,104,419 | A | | 4/1992 | Funk |
| 5,104,545 | A | | 4/1992 | Means et al. |
| 5,106,507 | A | | 4/1992 | Klock et al. |
| 5,112,358 | A | | 5/1992 | Deal |
| 5,116,426 | A | | 5/1992 | Asano et al. |
| 5,116,473 | A | | 5/1992 | Bostjancic |
| 5,118,322 | A | | 6/1992 | Wasinger et al. |
| 5,133,802 | A | | 7/1992 | Maekawa et al. |
| 5,135,656 | A | | 8/1992 | Means et al. |
| 5,143,579 | A | | 9/1992 | Field et al. |
| 5,146,693 | A | | 9/1992 | Dottor et al. |
| 5,151,026 | A | | 9/1992 | Anderson et al. |
| 5,154,854 | A | | 10/1992 | Zabotto et al. |
| 5,164,030 | A | | 11/1992 | Casper |
| 5,167,821 | A | | 12/1992 | Tanbo et al. |
| 5,173,200 | A | | 12/1992 | Kellett |
| 5,193,560 | A | | 3/1993 | Tanaka |
| 5,199,125 | A | | 4/1993 | Otto |
| 5,212,272 | A | | 5/1993 | Sargent et al. |
| 5,232,476 | A | | 8/1993 | Grant |
| 5,238,587 | A | | 8/1993 | Smith |
| 5,240,507 | A | | 8/1993 | Gray |
| 5,248,393 | A | | 9/1993 | Schumacher et al. |
| 5,256,557 | A | | 10/1993 | Shetty et al. |
| 5,268,150 | A | | 12/1993 | Burkitt |
| 5,269,958 | A | | 12/1993 | de Jager |
| 5,273,589 | A | | 12/1993 | Griswold et al. |
| 5,284,029 | A | | 2/1994 | Keuper et al. |
| 5,287,985 | A | | 2/1994 | Hatayama |
| 5,288,420 | A | | 2/1994 | Mandy |
| 5,288,422 | A | | 2/1994 | Basu |
| 5,290,473 | A | | 3/1994 | Basu |
| 5,294,644 | A | | 3/1994 | Login et al. |
| 5,300,154 | A | | 4/1994 | Ferber et al. |
| 5,300,197 | A | | 4/1994 | Mitani et al. |
| 5,304,253 | A | | 4/1994 | Grant |
| 5,304,320 | A | | 4/1994 | Barthelemy et al. |
| 5,308,562 | A | | 5/1994 | Wohlfahrt-Laymann |
| 5,315,727 | A | | 5/1994 | Lee |
| 5,316,690 | A | | 5/1994 | Li |
| 5,320,683 | A | | 6/1994 | Samejima |
| 5,334,258 | A | | 8/1994 | Osano |
| 5,340,443 | A | | 8/1994 | Heinio et al. |
| 5,340,464 | A | | 8/1994 | Mickas |
| 5,342,405 | A | | 8/1994 | Duncan |
| 5,344,527 | A | | 9/1994 | Mickas |
| 5,346,588 | A | | 9/1994 | Sixta et al. |
| 5,354,428 | A | | 10/1994 | Clark et al. |
| 5,354,480 | A | | 10/1994 | Robinson et al. |
| 5,360,547 | A | | 11/1994 | Cockett et al. |
| 5,368,649 | A | | 11/1994 | Tsukazaki |
| 5,377,705 | A | | 1/1995 | Smith |
| 5,392,480 | A | | 2/1995 | Ishihara |
| 5,404,732 | A | | 4/1995 | Kim |
| 5,405,542 | A | | 4/1995 | Trinh et al. |
| 5,405,767 | A | | 4/1995 | Shetty |
| 5,407,446 | A | | 4/1995 | Sando |
| 5,419,849 | A | | 5/1995 | Fields |
| 5,421,049 | A | | 6/1995 | Hendren |
| 5,423,921 | A | | 6/1995 | Saal |
| 5,426,955 | A | | 6/1995 | Modahl |
| 5,427,858 | A | | 6/1995 | Nakamura et al. |
| 5,431,827 | A | | 7/1995 | Tatch |
| 5,439,817 | A | | 8/1995 | Shetty et al. |
| 5,443,747 | A | | 8/1995 | Inada et al. |
| 5,447,171 | A | | 9/1995 | Shibano |
| 5,456,856 | A | | 10/1995 | Flaningam et al. |
| 5,460,018 | A | | 10/1995 | Werner |
| 5,461,742 | A | | 10/1995 | Pasad |
| 5,463,819 | A | | 11/1995 | Komori |

5,467,492 A 11/1995 Chao et al.
5,480,572 A 1/1996 Minor
5,488,842 A 2/1996 Nishioka et al.
5,490,894 A 2/1996 Matsuhisa
5,492,138 A 2/1996 Taricco
5,493,743 A 2/1996 Schneider
5,494,526 A 2/1996 Paranjpe
5,494,600 A 2/1996 Surutzidis et al.
5,498,266 A 3/1996 Takagawa et al.
5,500,096 A 3/1996 Yuan
5,501,811 A 3/1996 Flaningam et al.
5,503,681 A 4/1996 Inada et al. ..... 134/1
5,503,756 A 4/1996 Corona, III et al.
5,504,954 A 4/1996 Joo
5,505,985 A 4/1996 Nakamura et al.
5,511,264 A 4/1996 Nishioka et al.
5,518,624 A 5/1996 Filson et al.
5,524,358 A 6/1996 Matz
5,536,327 A 7/1996 Kaiser
5,536,374 A 7/1996 Spring
5,537,754 A 7/1996 Bachmann et al.
5,538,025 A 7/1996 Gray
5,538,746 A 7/1996 Levy
5,555,641 A 9/1996 Lee
5,586,456 A 12/1996 Takagawa et al.
5,591,236 A 1/1997 Roetker
5,593,598 A 1/1997 McGinness et al.
5,604,145 A 2/1997 Hashizume et al.
5,605,882 A 2/1997 Klug et al.
5,617,737 A 4/1997 Christensen et al.
5,622,630 A 4/1997 Romano
5,625,965 A 5/1997 Blissett et al.
5,637,336 A 6/1997 Kannenberg et al.
5,639,031 A 6/1997 Wright et al.
5,644,158 A 7/1997 Fujii et al.
5,645,727 A 7/1997 Bhave et al.
5,649,785 A 7/1997 Djerf et al.
5,653,873 A 8/1997 Grossman
5,656,246 A 8/1997 Patapoff et al.
5,668,102 A 9/1997 Severns et al.
5,676,005 A 10/1997 Balliett
5,689,848 A * 11/1997 Saal et al. ..... 8/159
5,712,240 A 1/1998 Tyerech et al.
5,718,293 A 2/1998 Flynn et al.
5,759,209 A 6/1998 Adler
5,765,403 A 6/1998 Lincoln et al.
5,773,403 A 6/1998 Hijino et al.
5,776,351 A 7/1998 McGinness et al.
5,776,362 A 7/1998 Sato et al.
5,787,537 A 8/1998 Mannillo
5,789,368 A 8/1998 You et al.
5,799,612 A 9/1998 Page
5,806,120 A 9/1998 McEachem
5,814,498 A 9/1998 Mani et al.
5,814,592 A 9/1998 Kahn et al.
5,814,595 A 9/1998 Flynn et al.
5,824,632 A 10/1998 Flaningam et al.
5,827,812 A 10/1998 Flynn et al.
5,840,675 A 11/1998 Yeazell
5,846,435 A 12/1998 Haase
5,849,197 A 12/1998 Taylor et al.
5,852,942 A 12/1998 Sharp et al.
5,853,593 A 12/1998 Miller
5,858,240 A 1/1999 Tardowski et al.
5,865,851 A 2/1999 Sidoti et al.
5,865,852 A 2/1999 Berndt
5,868,937 A 2/1999 Back et al.
5,876,461 A 3/1999 Racette et al.
5,876,685 A 3/1999 Krulik et al.
5,885,366 A 3/1999 Umino et al.
5,888,250 A 3/1999 Hayday et al. ..... 8/142
5,893,979 A 4/1999 Held
5,894,061 A 4/1999 Ladouceur
5,904,737 A 5/1999 Preston et al.
5,906,750 A 5/1999 Haase
5,912,408 A 6/1999 Trinh et al.
5,914,041 A 6/1999 Chancellor
5,925,469 A 7/1999 Gee
5,925,611 A 7/1999 Flynn et al.
5,935,441 A 8/1999 O'Neill et al.
5,935,525 A 8/1999 Lincoln et al.
5,942,007 A 8/1999 Berndt et al.
5,954,869 A 9/1999 Elfersy et al.
5,955,394 A 9/1999 Kelly
5,958,240 A 9/1999 Hoel
5,959,014 A 9/1999 Liebeskind et al.
5,960,501 A 10/1999 Burdick
5,960,649 A 10/1999 Burdick
5,962,390 A 10/1999 Flynn et al.
5,972,041 A 10/1999 Smith et al.
5,977,040 A 11/1999 Inada et al.
5,985,810 A 11/1999 Inada et al.
6,006,387 A 12/1999 Cooper
6,010,621 A 1/2000 Pattee
6,013,683 A 1/2000 Hill et al.
6,027,651 A 2/2000 Cash
6,029,479 A 2/2000 Pattee
6,042,617 A 3/2000 Berndt
6,042,618 A 3/2000 Berndt
6,045,588 A 4/2000 Estes et al. ..... 8/142
6,053,952 A 4/2000 Kaiser
6,056,789 A 5/2000 Berndt
6,059,845 A 5/2000 Berndt
6,059,971 A 5/2000 Vit et al.
6,060,108 A 5/2000 Burd et al.
6,063,135 A 5/2000 Berndt et al.
6,063,748 A 5/2000 Flynn et al.
6,086,635 A 7/2000 Berndt et al.
6,098,306 A 8/2000 Ramsey
6,113,815 A 9/2000 Elfersy
6,115,862 A 9/2000 Cooper
6,120,587 A 9/2000 Elfersy
6,122,941 A 9/2000 McClain
6,136,223 A 10/2000 Collins
6,136,766 A 10/2000 Inada et al.
6,149,980 A 11/2000 Behr et al.
6,156,074 A 12/2000 Hayday
6,159,376 A 12/2000 Lahti
6,159,917 A 12/2000 Baran
6,168,348 B1 1/2001 Weazell
6,168,714 B1 1/2001 Ilias et al.
6,171,346 B1 1/2001 Yeazell et al.
6,177,398 B1 1/2001 McGregor et al.
6,177,399 B1 1/2001 Mei et al.
6,190,556 B1 2/2001 Uhlinger
6,207,634 B1 3/2001 Meyer et al.
6,216,302 B1 4/2001 Preston et al.
6,217,771 B1 4/2001 Boyle et al.
6,221,944 B1 4/2001 Liebeskind
6,238,516 B1 5/2001 Watson et al.
6,238,736 B1 5/2001 Smith
6,239,097 B1 5/2001 Wilson
6,241,779 B1 6/2001 Collins
6,241,786 B1 6/2001 Zarges et al.
6,254,838 B1 7/2001 Goede
6,254,932 B1 7/2001 Smith
6,258,130 B1 7/2001 Murphy
6,258,276 B1 7/2001 Mika et al.
6,261,460 B1 7/2001 Benn et al.
6,269,667 B1 8/2001 Back
6,273,919 B1 8/2001 Hayday
6,274,540 B1 8/2001 Scheibel et al.
6,277,804 B1 8/2001 Kahn et al.
6,281,187 B1 8/2001 Smerznak
6,288,018 B1 9/2001 Flynn et al.
6,299,779 B1 10/2001 Pattee
6,309,425 B1 10/2001 Murphy
6,309,752 B1 10/2001 Dams et al.
6,310,029 B1 10/2001 Kilgour et al.
6,312,476 B1 11/2001 Perry et al.
6,312,528 B1 11/2001 Summerfield et al.
6,319,406 B1 11/2001 Freshour et al.
6,327,731 B2 12/2001 Back
6,334,340 B1 1/2002 Keglar et al.
6,348,441 B1 2/2002 Aiken et al.
6,350,377 B1 2/2002 Kollmar et al.
6,365,051 B1 4/2002 Bader
6,379,547 B1 4/2002 Larsson

| | | | | |
|---|---|---|---|---|
| 6,384,008 | B1 | 5/2002 | Parry | |
| 6,387,186 | B1 | 5/2002 | Reisig et al. | |
| 6,387,241 | B1 | 5/2002 | Murphy et al. | |
| 6,398,840 | B1 | 6/2002 | Orta-Castro et al. | |
| 6,399,357 | B1 | 6/2002 | Winge | |
| 6,402,956 | B1 | 6/2002 | Andou et al. | |
| 6,416,668 | B1 | 7/2002 | Al-Samadi | |
| 6,423,230 | B2 | 7/2002 | Ilias et al. | |
| 6,451,066 | B2 | 9/2002 | Estes et al. | |
| 6,475,968 | B1 | 11/2002 | Murphy et al. | |
| 6,479,719 | B1 | 11/2002 | Kotwica et al. | |
| 6,497,921 | B1 | 12/2002 | Carbonell | |
| 6,552,090 | B1 | 4/2003 | Behr et al. | |
| 6,558,432 | B2 | 5/2003 | Schulte et al. | 8/142 |
| 6,578,225 | B2 | 6/2003 | Jonsson | |
| 6,591,638 | B2 | 7/2003 | Estes et al. | |
| 6,653,512 | B1 | 11/2003 | Behr et al. | |
| 6,670,317 | B2 | 12/2003 | Severns et al. | |
| 6,691,536 | B2 | 2/2004 | Severns et al. | |
| 6,734,153 | B2 | 5/2004 | Scheper | |
| 6,736,859 | B2 | 5/2004 | Racette | |
| 6,743,262 | B1 | 6/2004 | Behr et al. | |
| 6,746,617 | B2 | 6/2004 | Radomyselski et al. | |
| 6,755,871 | B2 | 6/2004 | Damaso et al. | |
| 6,766,670 | B2 | 7/2004 | Estes et al. | |
| 6,770,615 | B1 | 8/2004 | Aouad et al. | |
| 6,811,811 | B2 | 11/2004 | Gerald France et al. | |
| 6,828,292 | B2 | 12/2004 | Noyes | |
| 6,828,295 | B2 | 12/2004 | Deak et al. | |
| 6,840,069 | B2 | 1/2005 | France et al. | |
| 6,855,173 | B2 | 2/2005 | Ehrnsperger et al. | |
| 6,860,108 | B2 | 3/2005 | Soechting et al. | |
| 6,860,998 | B1 | 3/2005 | Wilde | |
| 6,890,892 | B2 | 5/2005 | Scheper et al. | |
| 6,894,014 | B2 | 5/2005 | Deak et al. | |
| 6,898,951 | B2 | 5/2005 | Severns et al. | |
| 7,033,985 | B2 | 4/2006 | Noyes et al. | |
| 7,390,563 | B2 | 6/2008 | Kadoya | |
| 2001/0042275 | A1 | 11/2001 | Estes et al. | |
| 2001/0054202 | A1 | 12/2001 | Severns et al. | |
| 2002/0004950 | A1 | 1/2002 | Burns et al. | |
| 2002/0004952 | A1 | 1/2002 | Deak et al. | |
| 2002/0004995 | A1 | 1/2002 | France et al. | |
| 2002/0007519 | A1 | 1/2002 | Noyes et al. | |
| 2002/0010964 | A1 | 1/2002 | Deak et al. | |
| 2002/0010965 | A1 | 1/2002 | Schulte et al. | |
| 2002/0013234 | A1 | 1/2002 | Severns et al. | |
| 2002/0017493 | A1 | 2/2002 | Ehrnsperger et al. | |
| 2002/0019323 | A1 | 2/2002 | Bargaje | |
| 2002/0029427 | A1 | 3/2002 | Severns et al. | |
| 2002/0038480 | A1 | 4/2002 | Deak et al. | |
| 2002/0056163 | A1 | 5/2002 | Estes | |
| 2002/0056164 | A1 | 5/2002 | Estes et al. | |
| 2002/0110926 | A1 | 8/2002 | Kopf-Sill et al. | |
| 2002/0133885 | A1 | 9/2002 | Noyes et al. | |
| 2002/0133886 | A1 | 9/2002 | Severns et al. | |
| 2003/0037809 | A1 | 2/2003 | Favaro | |
| 2003/0046963 | A1 | 3/2003 | Scheper et al. | |
| 2003/0070238 | A1 | 4/2003 | Radomyselski et al. | |
| 2003/0080467 | A1 | 5/2003 | Andrews | |
| 2003/0084588 | A1 | 5/2003 | France et al. | |
| 2003/0092592 | A1 | 5/2003 | Bargaje et al. | |
| 2003/0097718 | A1 | 5/2003 | Evers et al. | |
| 2003/0196277 | A1 | 10/2003 | Hallman et al. | |
| 2003/0196282 | A1 | 10/2003 | Fyvie et al. | |
| 2003/0204917 | A1 | 11/2003 | Estes et al. | |
| 2003/0226214 | A1 | 12/2003 | Radomyselski et al. | |
| 2003/0227394 | A1 | 12/2003 | Rothgeb | |
| 2004/0045096 | A1* | 3/2004 | Mani et al. | 8/142 |
| 2004/0088795 | A1 | 5/2004 | Orchowski et al. | |
| 2004/0088846 | A1 | 5/2004 | Murphy et al. | |
| 2004/0117919 | A1 | 6/2004 | Conrad et al. | |
| 2004/0117920 | A1 | 6/2004 | Fyvie et al. | |
| 2004/0129032 | A1 | 7/2004 | Severns et al. | |
| 2004/0139555 | A1 | 7/2004 | Conrad | |
| 2005/0000897 | A1 | 1/2005 | Radomyselski et al. | |
| 2005/0037935 | A1 | 2/2005 | Abd Elhamid et al. | |
| 2005/0043196 | A1 | 2/2005 | Wright et al. | |
| 2005/0071928 | A1 | 4/2005 | Wright et al. | |
| 2005/0076453 | A1 | 4/2005 | Lucas et al. | |
| 2005/0091755 | A1 | 5/2005 | Conrad et al. | |
| 2005/0091756 | A1 | 5/2005 | Wright | |
| 2005/0091757 | A1 | 5/2005 | Luckman et al. | |
| 2005/0092033 | A1 | 5/2005 | Luckman et al. | |
| 2005/0092352 | A1 | 5/2005 | Luckman | |
| 2005/0096242 | A1 | 5/2005 | Luckman et al. | |
| 2005/0096243 | A1 | 5/2005 | Luckman et al. | |
| 2005/0126606 | A1 | 6/2005 | Goedhart | |
| 2005/0132502 | A1 | 6/2005 | Goldoni | |
| 2005/0133462 | A1 | 6/2005 | Goldini | |
| 2005/0150059 | A1 | 7/2005 | Luckman et al. | |
| 2005/0155393 | A1 | 7/2005 | Wright et al. | |
| 2005/0183208 | A1* | 8/2005 | Scheper et al. | 8/142 |
| 2005/0187125 | A1 | 8/2005 | Deak et al. | |
| 2005/0222002 | A1 | 10/2005 | Luckman et al. | |
| 2005/0224099 | A1 | 10/2005 | Luckman et al. | |
| 2005/0257812 | A1 | 11/2005 | Wright et al. | |
| 2005/0263173 | A1 | 12/2005 | Luckman et al. | |
| 2006/0260064 | A1 | 11/2006 | Luckman et al. | |
| 2006/0260065 | A1 | 11/2006 | Wright et al. | |

FOREIGN PATENT DOCUMENTS

| | | | | |
|---|---|---|---|---|
| DE | 4343488 | A1 | | 6/1995 |
| DE | 60116093 | A | | 8/2006 |
| EP | 0182583 | | | 11/1985 |
| EP | 0246007 | | | 3/1992 |
| EP | 6233898 | | | 8/1994 |
| EP | 0623389 | | | 11/1994 |
| EP | 0707060 | | | 7/1998 |
| EP | 1041189 | | | 10/2000 |
| EP | 1290259 | | | 3/2003 |
| EP | 1528138 | | | 10/2004 |
| EP | 1528140 | | | 10/2004 |
| EP | 1528141 | | | 10/2004 |
| EP | 1536052 | | | 10/2004 |
| GB | 1002318 | | | 8/1965 |
| JP | 59006944 | | | 10/1975 |
| JP | 1236303 | A | | 9/1989 |
| JP | 03128098 | | | 5/1991 |
| JP | 5064521 | A | | 3/1993 |
| JP | 006233898 | | | 8/1994 |
| JP | 6233898 | | * | 8/1994 |
| JP | 2002114089 | | | 4/2002 |
| JP | 2003307386 | A | * | 10/2003 |
| WO | WO 98/06815 | | | 2/1998 |
| WO | WO 98/06818 | | | 2/1998 |
| WO | WO 98/29595 | | | 7/1998 |
| WO | WO 99/14175 | | | 3/1999 |
| WO | WO 00/04222 | | | 1/2000 |
| WO | WO 0004221 | | | 1/2000 |
| WO | WO0042689 | | | 7/2000 |
| WO | WO 01/06051 | | | 1/2001 |
| WO | WO 01/06054 | | | 1/2001 |
| WO | WO 01/13461 | | | 2/2001 |
| WO | WO 01/34613 | | | 5/2001 |
| WO | WO 01/44256 | | | 6/2001 |
| WO | WO 01/48297 | | | 7/2001 |
| WO | 01/94675 | A2 | | 12/2001 |
| WO | WO 01/94675 | | | 12/2001 |
| WO | WO 01/94677 | | | 12/2001 |
| WO | WO 01/94680 | | | 12/2001 |
| WO | WO 01/94683 | | | 12/2001 |
| WO | WO 01/94685 | | | 12/2001 |
| WO | WO 01/94690 | | | 12/2001 |
| WO | WO0194683 | | * | 12/2001 |

OTHER PUBLICATIONS

U.S. Appl. No. 11/135,181, filed May 23, 2005, Wright et al.
U.S. Appl. No. 11/135,213, filed May 23, 2005, Luckman et al.
U.S. Appl. No. 11/135,214, filed May 23, 2005, Luckman et al.
European Commission Enterprise Directorate-General (The Advantages and Drawbacks of Introducing Comm.
US 5,885,851 (withdrawn).
http:www.jamplast.com/plastic_data_PP2.htm; Aug. 20, 2007.

* cited by examiner

METHODS AND APPARATUS TO ACCELERATE THE DRYING OF AQUEOUS WORKING FLUIDS

CROSS-REFERENCE TO RELATED APPLICATIONS

The present application is related to the following applications of overlapping inventorship and common ownership hereof and filed the same day as this application: "A Multi-functioning Machine And Method Utilizing A Two Phase Non-Aqueous Extraction Process", Ser. No. 11/135,181, "Methods And Appratus For Laundering With Aqueous And Non-Aqueous Working Fluids", Ser. No. 11/135,146, "A Method For A Semi-Aqueous Wash Process And A Recovery Method Employing The Same", Ser. No. 11/135,213, and "A Method For Fluid Recovery In A Semi-Aqueous Wash Process", Ser. No. 11/135,214.

The present application is also related to the following applications, the specifications and drawings of which we incorporated by reference: Ser. No. 10/957,484, "Method and Apparatus Adapted for Recovery and Reuse of Select Rinse Fluid in a Non-Aqueous Wash Apparatus" filed Oct. 01, 2004; Ser. No. 10/957,485 "A Fabric Laundering Apparatus Adapted for Using a Select Rinse Fluid, filed Oct. 01, 2004, Ser. No. 10/956,707 "A Method for Laundering Fabric with a Non-Aqueous Working Fluid Using a Select Rinse Fluid, filed Oct. 01, 2004; Ser. No. 10/957,555 "Fabric Laundering Using a Select Rinse Fluid and Wash Fluids, filed Oct. 01, 2004; Ser. No. 10/957,451 "Non-Aqueous Washing Apparatus and Method, filed Oct. 01, 2004, Ser. No. 10/957,486 "Non-Aqueous Washing Apparatus and Method, filed Oct. 01, 2004; and Ser. No. 10/957,487 "Non-Aqueous Washing Machine and Methods", filed Oct. 01, 2004.

TECHNICAL FIELD OF THE INVENTION

The invention relates to methods and apparati for laundering fabric where the wash step can be comprised of a combination of steps involving different working fluids such as an aqueous, non-aqueous, or combination working fluid.

BACKGROUND OF THE INVENTION

The present invention relates to a program of events, ingredients, controls, and sensors that make it possible to produce a laundering machine that is self-contained, automatic, and relatively compact. It can be used in the home, lightly in industry as well as commercially, and is capable of utilizing a complete aqueous cycle, a semi-aqueous cycle, or a non-aqueous cycle. Additionally, the present invention describes a method of drying fabric that contains water and a soil. The machine offers the consumer the ability not only to launder their traditional fabrics (cotton, polyesters, etc.) at home, but also have the ability to handle delicate fabrics such as dry-clean only fabrics, nano-coated fabrics, and fabrics that contain electronics as well.

Water, as a cleaning solvent itself, has many benefits as well as disadvantages. Water is useful as a cleaning agent for many soils especially hydrophilic soils and provides excellent solubility characteristics with conventional detergent formulations. However, water is responsible for damage (shrinkage and wrinkling) to many of the traditional garments laundered at home. Additionally, water is very polar causing it to hydrogen bond readily, has a high heat capacity, and a low vapor pressure making it difficult to remove from fabric without adding a lot of energy either in terms of heat or centrifugation.

On the contrary to aqueous-based cleaning, there have been numerous attempts at making a non-aqueous laundering system; however, there have been many limitations associated with such attempts. Traditional dry-cleaning solvents such as perchloroethylene are not feasible for in-home applications because they suffer from the disadvantage of having perceived environmental and health risks. Fluorinated solvents such as hydrofluoroethers have been proposed as potential solvents for such an application. These solvents are environmentally friendly, have high vapor pressures leading to fast drying times, and provide some level of cleaning, but have some limitations with hydrophilic stain removal.

Other solvents have been listed as potential fluids for such an application. Siloxane-based materials, glycol ethers, and hydrocarbon-based solvents all have been investigated. Typically, these solvents are combustible fluids but the art teaches some level of soil removal. However, since these solvents are combustible and usually have low vapor pressures, it would be difficult to dry with traditional convection heating systems. The solvents have low vapor pressures making evaporation slow; thus increasing the drying time needed for such systems. Currently, the National Fire Protection Association has product codes associated for flammable solvents. These safety codes limit the potential heat such solvents could see or the infrastructure needed to operate the machine. In traditional washer/dryer combination machines, the capacity or load size is limited based on the drying rate. However, with the present invention, the capacity of the machines will be more dependent upon the size of the drum than the size of the load.

The present invention uses some of these aforementioned solvents to clean fabrics without the drying problems associated with these solvents. This is accomplished by using a non-flammable, non-aqueous working fluid that solves many of these drying problems. This system incorporates a process wherein water or other polar solvents could be used as cleaning fluids and traditional means for removing the aqueous solvent from the fabric such as convection based drying methods could be utilized. This present invention also allows for a non-aqueous drying means for these aqueous cleaning solvents. Additionally aqueous and non-aqueous solvents can be combined giving the consumer the semi-aqueous option of cleaning with an aqueous solvent for superior hydrophilic soil removal, cleaning with a non-aqueous fluid for superior hydrophobic soil removal, and then drying with one or more non-aqueous fluids to provide reasonable drying/cycle times. Further the consumer can select a complete non-aqueous cycle wherein a non-aqueous fluid cleans the fabric and the same or an additional non-aqueous fluid is used for drying.

U.S. Pat. No. 5,498,266 describes a method using petroleum-based solvent vapors wherein perfluorocarbon vapors are admixed with petroleum solvent vapors to remove the solvents from the fabrics and provide improvements in safety by reducing the likelihood of ignition or explosion of the vapors. However, the long-term stability of these mixtures is unknown but has the potential of separating due to dissociating the separate components.

U.S. Pat. No. 6,045,588 describes a method for washing, drying and recovering using an inert working fluid. Additionally, this application teaches the use of liquid extraction with an inert working fluid along with washing and drying.

U.S. Pat. No. 6,558,432 describes the use of a pressurized fluid solvent such as carbon dioxide to avoid the drying issues. In accordance with these methods, pressures of about 500 to 1000 psi are required. These conditions would result in larger machines than need be for such an operation. Additionally, this is an immersion process that may require more than one rinse so additional storage capacity is needed.

US Patent Publication Number 20030084588 describes the use of a high vapor pressure, above 3-mm Hg, co-solvent that is subjected to lipophilic fluid containing fabric articles. While a high vapor pressure solvent may be preferred in such a system, US 20030084588 fails to disclose potential methods of applying the fluid, when the fluid should be used, methods minimizing the amount of fluid needed as well as potential use of aqueous fluids as well.

Various perfluorocarbons materials have been employed alone or in combination with cleaning additives for washing printed circuit boards and other electrical substrates, as described for example in U.S. Pat. No. 5,503,681. Spray cleaning of rigid substrates is very different from laundering soft fabric loads. Moreover, cleaning of electrical substrates is performed in high technology manufacturing facilities employing a multi-stage that is not readily adaptable to such a cleaning application.

U.S. Pat. No. 5,888,250 describes a biodegradable ether solvent which may be used as a dry cleaning solvent or as a solvent for completing non-aqueous cleaning in the home.

US Patent Publication Number 20030046963 is a patent application disclosing a machine that can be preprogrammed to use a selective amount of water for laundering fabrics.

WO 0194675 describes the use of an apparatus capable of aqueous and non-aqueous methods for laundering. This application fails to teach any embodiments in which these methods can be easily practiced. Additionally, the solvent choices readily identified by this application, decamethylcyclopentasiloxane and water, are readily incompatible and for such a machine or method to work the apparatus would need to be equipped with separate hosing or involve a clean-out cycle between runs utilizing a solvent or water. This application differs from the present invention in that the present invention describes an additional semi-aqueous method plus describes methods in detail on how to minimize the cycle times for both aqueous and non-aqueous-based cleaning fluids.

US Patent Publication Number 20030196277 describes figures wherein an apparatus is capable of completing both a solvent-based cleaning and water washing process. This application fails to teach any embodiments wherein the aforementioned processes can be completed. The present invention not only discloses and teaches methods, chemistries, and apparatus wherein a non-aqueous and aqueous cleaning cycle are possible, but methods for minimizing solvent usage as well as processes for minimizing cycle time.

The disclosures and drawings of each of the above references are incorporated herein by reference.

An object of the present invention is to provide a complete sequence of laundering wherein the system can utilize an aqueous process, a semi-aqueous process, or a non-aqueous process while drying quickly.

A further object of the invention is the provision of a specific process wherein an aqueous wash is followed by a non-aqueous rinse to improve the cycle time by reducing the time needed to dry.

Another object of the invention is the provision of techniques and methods for minimizing the amount of non-aqueous fluid needed and the time that the non-aqueous fluid should be in contact with the fabric articles.

Another object of the invention is the provision of a low energy drying process that results in improved fabric care and shorter drying times.

Another object of the invention is the provision of recovery methods and techniques for the semi-aqueous and non-aqueous systems described in this invention.

A further object of the invention is the provision of a single apparatus with multiple working fluid options including water wherein the apparatus is designed to complete either an aqueous, semi-aqueous, or non-aqueous laundering methods, low temperature drying, and recovery methods.

A further object of the invention is the provision of means for concentrating and disposing of soils in an environmentally friendly manner.

It is a further object that the materials used are all of a type that avoids explosion and manages flammability hazards.

Another object of the present invention is the provision of means wherein the drying always occurs in the presence of a non-flammable fluid rich environment.

It is still a further object of the present invention that the consumer can select an aqueous cleaning cycle and a non-aqueous fast drying cycle.

Another object of the present invention is the provision of means whereby the consumer can select a non-aqueous fast drying cycle with a traditional hand/feel wherein moisture is added at the end of the cycle.

It is still a further object of the present invention to provide specific chemistries and materials that make the aqueous, semi-aqueous, and non-aqueous processes of the present invention possible.

Further objects and advantages of the invention will become apparent to those skilled in the art to which this invention relates from the following description of the drawings and preferred embodiments that follow:

DETAILED DESCRIPTION OF THE INVENTION

Figure 1:
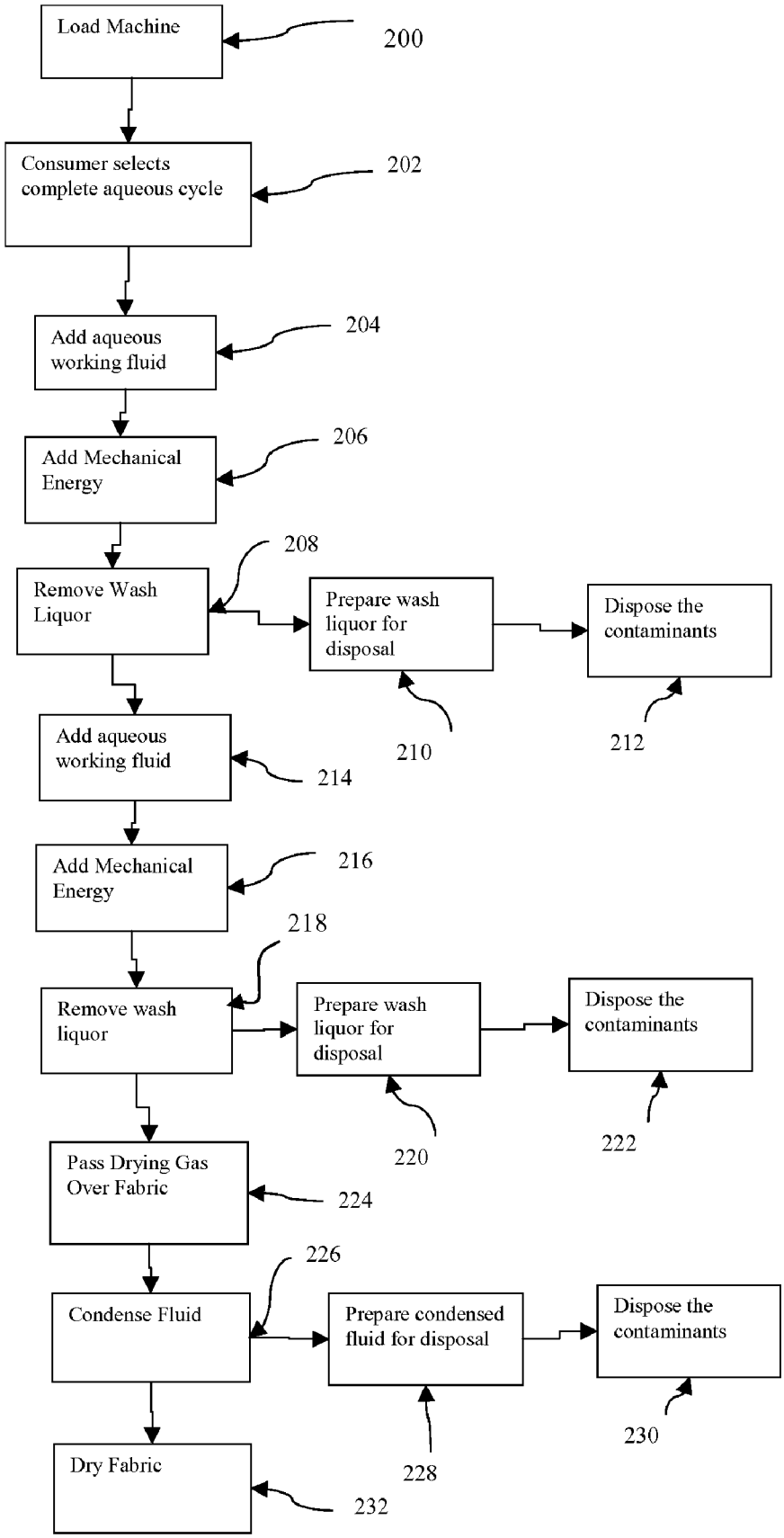
FIG. 1 is a flow diagram of one embodiment of wash, rinse, dry, and recovery events that with materials described make possible a laundering machine with an aqueous, semi-aqueous, and non-aqueous method.

Modifications of the machine shown in U.S. Patent Application 20040117919 has been used to test the efficacy of the washing and recovery operations of the present invention and which are described in the following specification are incorporated herein by reference.

patent application Ser. No. 10/956,707 describes a similar technique utilizing a select rinse fluid and is therefore, included herein for reference.

Figures in both the aforementioned cases (US 20040117919 and Ser. No. 10/956,707) show machines that can be used for techniques described in this invention. In the instance for both an aqueous and non-aqueous working fluid, it should be noted that the dispensers might be separate for each classification of fluid, chambered separately within the same housing, or be the same dispenser. The key features would be sensing technology that would recognize the differences that exist between the working fluid's detergent formulation; thus indicating to the consumer that the wrong detergent type has been entered.

One embodiment of the present invention could comprise a consumable detergent composition comprising a surfactant capable of enhancing soil removal benefits and additionally being dissolved in either aqueous and/or non-aqueous working fluid, an aqueous and/or non-aqueous fluid, optionally other cleaning adjuncts capable of enhancing soil removal. The aqueous fluid, non-aqueous fluids and cleaning adjuncts which could be utilized in such a consumable composition will be discussed later in the specification. In addition, the constituents of the composition can be compounded within the confines of the machine.

The heater should be controlled in such a way that it can be operated regardless of the working fluid selected for operation. If the working fluid selected has a flash point, the heater should regulate the system to control the temperature to 30° F. below the flash point of the working fluid if the concentration of the working fluid exceeds 0.25% of its lower flammability limit or the oxygen concentration is greater than 8%.

Other condensing methods not mentioned may be utilized for such an invention. The condenser can be additionally selected from air to air heat exchangers, cold wire inserts, tube bank heat exchanger, cross-flow, counter flow, tube and shell, impinging jets, evaporative cooling, spray droplets, trickle beds, condensing spinning discs, cooling towers, thermoelectric or combinations thereof. The cooling medium can be air, water, refrigerant, or the working fluid. The condenser should be designed to handle multiple fluids and separate multiple fluids upon condensation.

FIGS. 1-6 illustrate various methods of washing and drying fabrics in accordance with the present invention. In FIGS. 1-6, a first step in practicing the present invention is the loading of the machine 200 or chamber. The consumer can select a complete aqueous cycle in step 202 after or prior to the loading of the machine. The next step involves the addition of the aqueous working fluid, 204. This working fluid may be a polar solvent as well. A polar solvent is a solvent or molecule with a permanent electric dipole moment as defined by Atkins $5^{th}$ Edition of Physical Chemistry. The permanent moment arises from the partial charges on the atoms in the molecule that arise from differences in electronegativity or other features of bonding. The term purposively added water is meant to describe water added for the purpose of cleaning, drying, extracting, etc. An example of non-purposively added water is water moisture that results from the humidity of the environment and that is naturally contained within a fabric article. A method of characterizing the aqueous working fluid is through their Hansen solubility parameters. The aqueous working fluid aforementioned can be characterized as having a Hansen Solubility Polarity Parameter of greater than 6 dynes/cm or a hydrogen bonding solubility parameter greater than 15 dynes/cm. Optionally, additives can be added to the aqueous working fluid to further promote soil removal, care of the fabric, whitening or other features. The working fluid and additives comprise the wash liquor.

The washing additive can be selected from the group consisting of: builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents and mixtures thereof.

The wash liquor is preferably a combination of a working fluid and optionally at least one washing additive. The chamber by its rotation adds mechanical energy 206 to the combination of the working fluid and fabric. The mechanical energy may be of the form of, but is not limited to, tumbling, agitating, impelling, nutating, counter-rotating the drum, liquid jets that spray fluids thus moving the fabrics, vibrating, oscillating, or combinations thereof. This mechanical energy is one form for processing the fabric load. Other forms may include adding, mixing and removing the fabric load. The mechanical energy should be added continuously or intermittently for a time ranging from 2-120 minutes, but may be longer depending on the amount of cleaning needed. The wash liquor is then removed in step 208. Potential methods for removing the wash liquor include, but are not limited to, centrifugation, liquid extraction, the application of a vacuum, the application of forced heated air, capillarity, the application of pressurized air, simply allowing gravity to draw the wash liquor away from the fabric, the application of moisture absorbing materials or mixtures thereof.

After removing the wash liquor, the wash liquor is prepared for disposal, 210. This process may be different than traditional laundry processes of today in that this step involves determining the amount of non-aqueous contaminants that exist in the liquor make-up and determining whether this amount can or should be disposed of down the drain. In step 212, the contaminants are disposed. The contaminants can be disposed down the drain or collected in a filter device and then disposed of periodically. The periodic disposal gives the flexibility of the machine not having to be located close to a water source.

A preferred embodiment of such a technique is to add wash liquor to a fabric load, processing the fabric load resulting in a second wash liquor, measuring the concentration of a non-aqueous fluid (i.e. decamethylcyclopentasiloxane) in the second wash liquor, if the concentration exceeds a predetermined acceptable level (i.e. 2%) the processing the second wash liquor to form a third and optionally fourth wash liquors and then disposing of said wash liquors.

Additional aqueous working fluid can be added as a rinse fluid or as a second wash step in 214. The working fluid can be accompanied by washing additives and the wash liquor is then mixed with the fabric load through added mechanical energy, 216. The added mechanical energy is similar to that described above. The wash liquor is removed in 218 and all the remaining steps involving the removal of the working fluid from the fabric load can be accomplished via the aforementioned techniques.

The wash liquor is prepared for disposal in 220 and this can be similar to or different than the preparation technique in step 210 and disposed in 222. The number of rinses can vary and steps 214 through 222 can be repeated as often as necessary.

A drying gas is introduced in step 224 and the working fluid is removed from the fabric and routed through a condenser and condensed in step 226. The drying gas can be selected from, but is not limited to, the following: air, nitrogen, carbon dioxide, other inert gases, and mixtures thereof. The fluid condensed in step 226 is prepared for disposal in step 228. This step may be similar to or different from steps 210 and 220 mentioned above. The contaminants are collected and then disposed in step 230. The disposal of contaminants could occur together if necessary. This embodiment describes a condensing drying technique that would result in a dry fabric load, 232. It should be noted that an open-loop drying system might be utilized where the working fluid vapor removed from the fabric during the drying process is removed from the system via ventilation to an external environment. An open-loop system is only possible for an aqueous cycle with a traditional dry. Some embodiments may incorporate a condensing, closed-loop as well as open-loop system depending on the working fluid choice. Open-loop drying in meant to describe a technique which takes the air from the drum and vents it externally to the environment without passing through a scrubbing technique such as adsorption, absorption or filtration.

Figure 2:
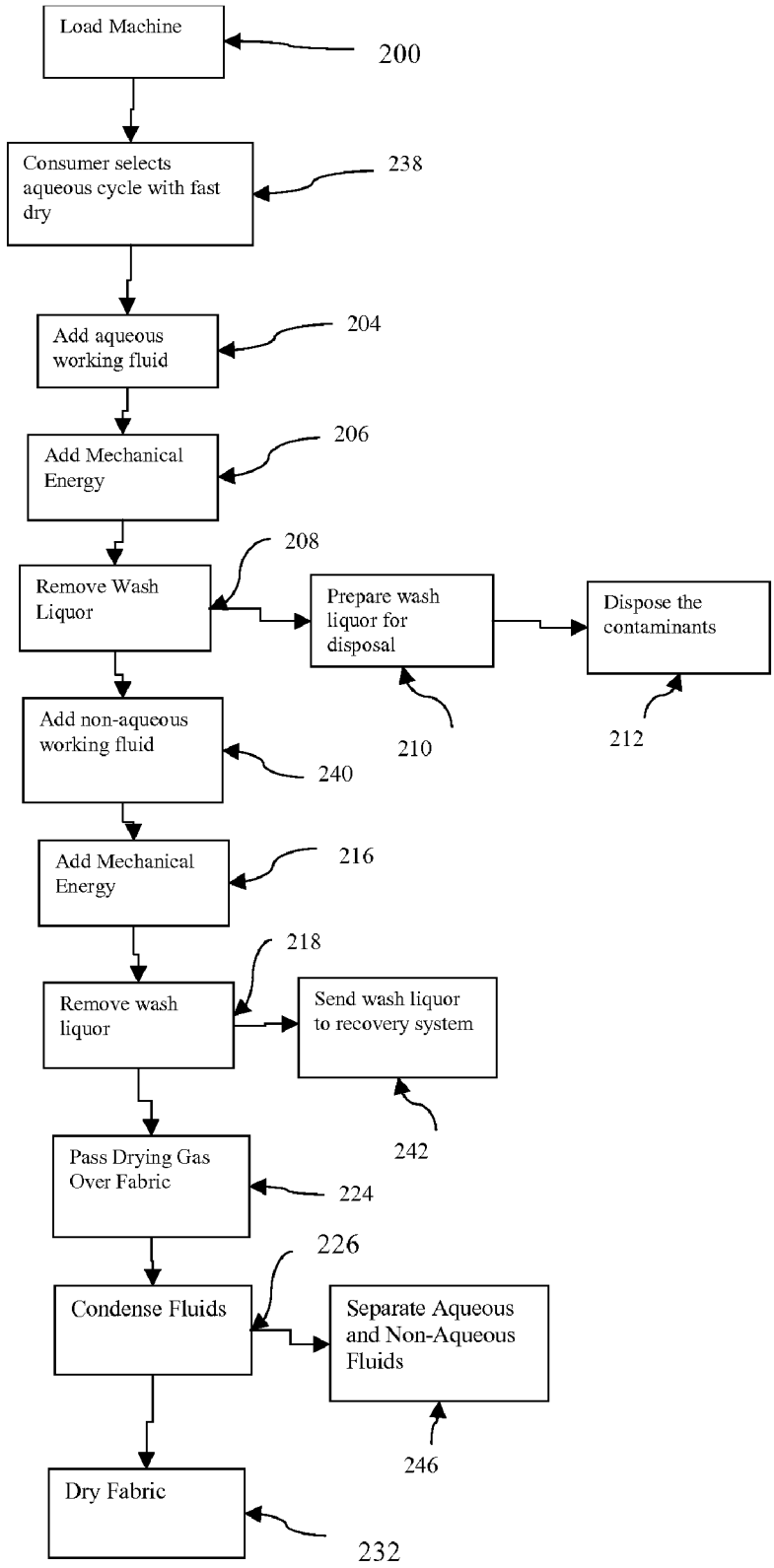
FIG. 2 is a flow diagram of a second embodiment of wash, rinse, dry, and recovery events that with materials described make possible a laundering machine with an aqueous, semi-aqueous, and non-aqueous method.

The process described in FIG. 2 begins in a similar fashion to that in FIG. 1. The machine is loaded and the consumer selects an aqueous cycle with a fast dry, 238. The aqueous working fluid is added, mechanical energy is applied, the wash liquor is removed, and the working fluid is prepared for disposal. A non-aqueous working fluid is added in step 240. This non-aqueous fluid is added to remove more of the aqueous working fluid from the fabric, to provide cleaning of some hydrophobic soils that are difficult to remove with aqueous working fluids, and to improve the drying process and cycle time. The working fluid is selected for having miscibility with the aqueous working fluid and being non-flammable. The miscibility of the working fluid with the aqueous working fluid should be less than 20% by weight without the addition of any solubility enhancers such as temperature, pressure or surfactants, and preferably less than 10%. The non-flammability characteristics are described by the closed cup flammability as defined by the 2000 edition of the National Fire Protection Association. Further, the working fluid should have a vapor pressure greater than 5 mm Hg under standard operating conditions. Such fluids that are potential non-aqueous working fluids for the current embodiment include but are not limited to fluorinated solvents, ionic liquids and carbon dioxide. More specifically the working fluid is further selected from the group including but not limited to methoxynonafluorobutane, ethoxynonafluorobutane, HFE-7300, or combinations thereof. HFE-7300 is a fluorinated solvent from 3M with a $CF_3CF_2CF(OCH_3)CF(CF_3)_2$ structure.

Additives can be coupled with the non-aqueous working fluid to further enhance the removal of the aqueous working fluid, the soil removal and/or the reduction of cycle time. These additives can be similar to those added with the aqueous working fluid or different. The additive can be selected from the group consisting of: builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents, temperature, pressure and mixtures thereof. Mechanical energy may be applied in the form of, but not limited to, tumbling, agitating, impelling, nutating, counter-rotating the drum, liquid jets that spray fluids thus moving the fabrics, vibrating, oscillating, or combinations thereof is added to the drum, 216. The wash liquor is removed from the drum in step 218. The removed wash liquor is sent to the recovery system, 242, which will be described in greater detail later in the specification.

The addition of the non-aqueous working fluid to the drum can be completed prior to completing a series of one or more aqueous rinse steps. The non-aqueous working fluid addition can be completed one or more times to decrease the aqueous working fluid concentration below a set value or until enough soil has been removed. The longer contact time and the more the non-aqueous fluid used in the rinse, the lower concentration of the remaining non-aqueous fluid. A drying gas is passed over the fabrics in step 224. The drying gas can be selected from, but not limited to, air, nitrogen, carbon dioxide, other inert gases, and mixtures thereof. Optionally, the drying gas can be heated to improve the removal of the working fluids from the fabric. The drying gas containing working fluid vapor is then passed over a condenser and the working fluids are condensed, 226. The condensed fluids are then separated in 246 and dry fabric, 232, results when sufficient working fluid vapor has been removed from the fabric.

Figure 3:
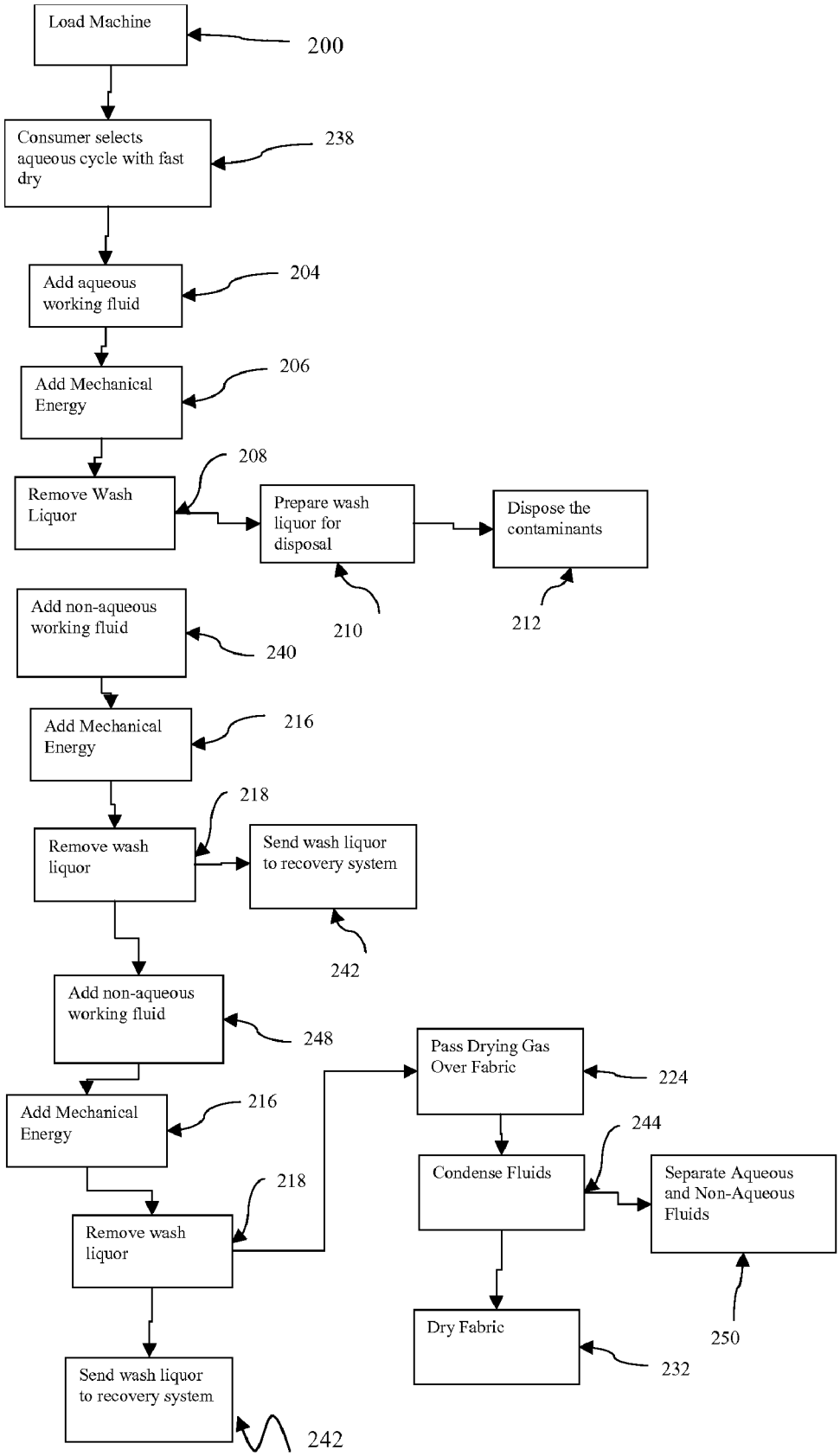
FIG. 3 is a flow diagram of a third embodiment of wash, rinse, dry, and recovery events that with materials described make possible a laundering machine with an aqueous, semi-aqueous, and non-aqueous method.

A further embodiment is described in FIG. 3. This particular process is similar to that described in FIG. 2 until the addition of the non-aqueous working fluid in step 240. This non-aqueous fluid should be miscible with an aqueous working fluid to greater than at least 0.05% and have a flash point preferably greater than 140° F. as defined by the National Fire Protection Association. It is preferable that the non-aqueous working fluid has a surface tension lower than that of the aqueous working fluid. A further characteristic identifying viable non-aqueous working fluids is Hansen Solubility Dispersion Parameters greater than 12 dynes/cm and a Hansen Solubility Hydrogen Bonding Parameter greater than 10 dynes/cm. Working fluids that are acceptable as non-aqueous working fluids as mentioned above include but are not limited to terpenes, halohydrocarbons, glycol ethers, polyols, ethers, esters of glycol ethers, esters of fatty acids and other long chain carboxylic acids, fatty alcohols and other long chain alcohols, short-chain alcohols, polar aprotic solvents, siloxanes, hydrofluoroethers, dibasic esters, aliphatic hydrocarbons, carbon dioxide, ionic liquids, glycol ether acetates, and/or combinations thereof. Even more preferably, the working fluid is further selected from decamethylcyclopentasiloxane, dodecamethylpentasiloxane, octamethylcyclotetrasiloxane, decamethyltetrasiloxane, dipropylene glycol n-butyl ether (DPnB), dipropylene glycol n-propyl ether (DPnP), dipropylene glycol tertiary-butyl ether (DPtB), propylene glycol n-butyl ether (PnB), propylene glycol n-propyl ether (PnP), tripropylene methyl ether (TPM), i-propyl myristate, soy clear methyl esters, ethyl hexyl lactate, and/or combinations thereof.

At least one washing additive can be added to the non-aqueous working fluid. This washing additive can be similar or different from the washing additive added with the aqueous working fluid. The washing additive can be selected from the group consisting of: builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents and mixtures thereof.

Figure 4:
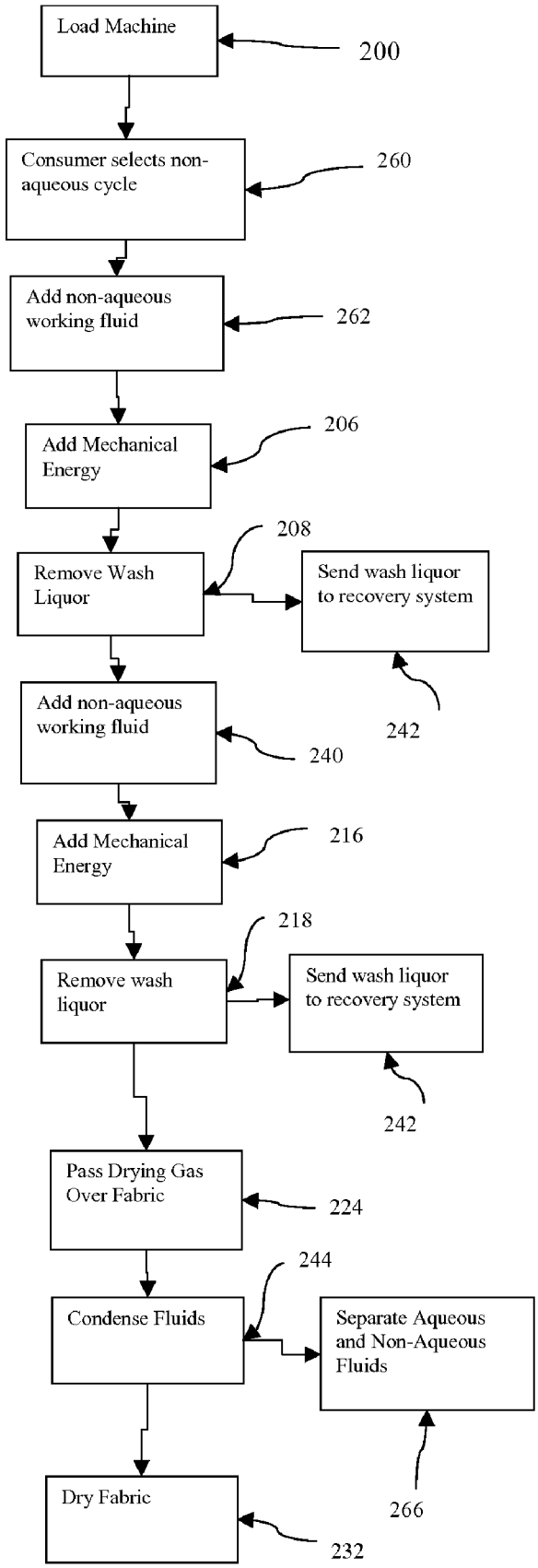
FIG. 4 is a flow diagram of a fourth embodiment of wash, rinse, dry, and recovery events that with materials described make possible a laundering machine with an aqueous, semi-aqueous, and non-aqueous method.
Figure 5:
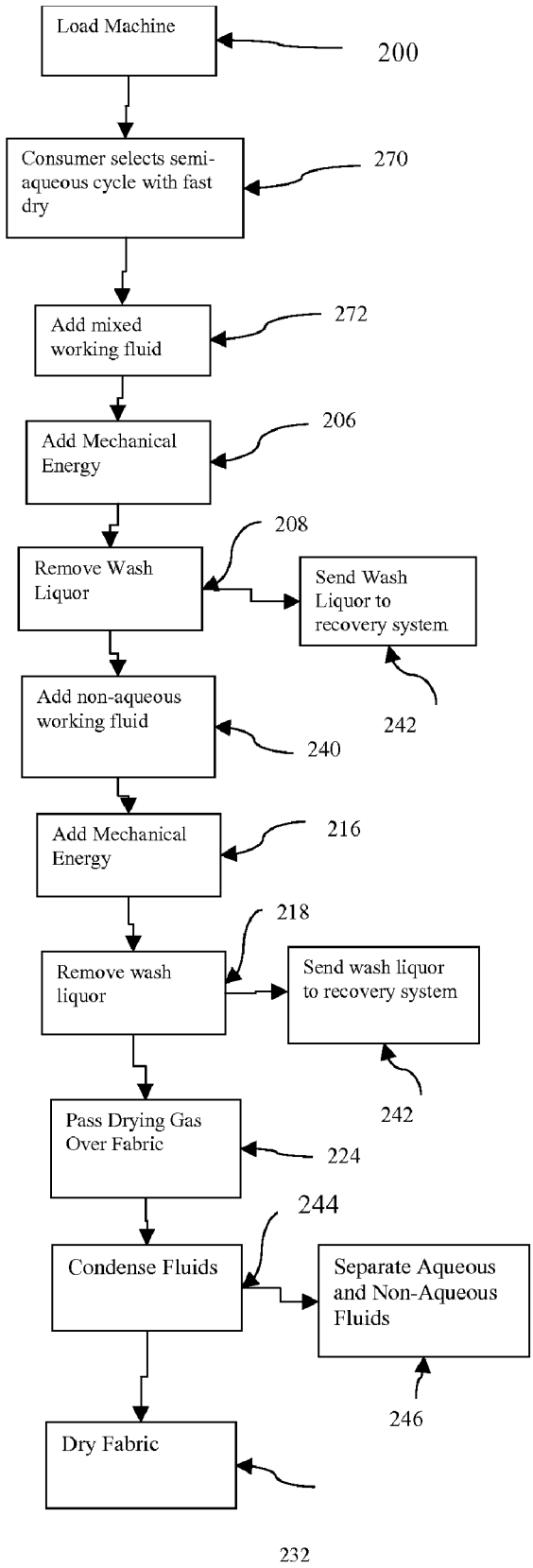
FIG. 5 depicts a flow diagram of a fifth embodiment of wash, rinse, dry, and recovery events that with materials described make possible a laundering machine with an aqueous, semi-aqueous, and non-aqueous method.

The next difference between FIGS. 4 and 5 takes place after the wash liquor is removed and sent to the recovery system. The addition of the non-aqueous working fluid can take place once and/or for a time sufficient to lower the concentration of remaining working fluid below a set value. This value is preferably less than 50% by mass of the fabric, more preferably less than 25% and most preferably less than 15%. An additional non-aqueous working fluid is added in step 248. This non-aqueous working fluid is added to remove the first non-aqueous working fluid, to decrease the time needed to remove the remaining working fluid and aqueous working fluid and to provide a non-flammable fluid as the final fluid. The preferred characteristics of this non-aqueous fluid include a surface tension lower than the first two working fluids added, a Kauri-Butanol value less than the KB value of the non-aqueous working fluid added in the prior sequence of steps and the working fluid should be non-flammable. Further, the non-aqueous working fluid is selected based on being miscible with the non-aqueous working fluid added during the previous sequence of steps and having Hanson solubility parameters (expressed in dynes per centimeter) with one of the following criteria: a polarity greater than about 3 and hydrogen bonding less than 9; hydrogen bonding less than 13 and dispersion from about 14 to about 17; or hydrogen bonding from about 13 to about 19 and dispersion from about 14 to about 22. More specifically the non-aqueous working fluid will be selected for having the following properties: have a viscosity less than the viscosity of the working fluid and/or a vapor pressure greater than 5 mm Hg at standard conditions.

Even more specifically, the non-aqueous working fluid is selected from the group consisting of perfluorinated hydrocarbons, decafluoropentane, hydrofluoroethers, methoxynonafluorobutane, ethoxynonafluorobutane, carbon dioxide, ionic liquids, HFE-7300, and/or mixtures thereof. At least one washing additive can be added to the second non-aqueous fluid. These additives can be the same or different from those added in any of the previous steps. The washing additive can be selected from the group consisting of: builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents and mixtures thereof.

Mechanical energy is then added to the system. After a time sufficient to lower the concentration of the first non-aqueous working fluid to lower than 50% by mass of the fabric, more preferably less than 25% and most preferably less than 15%, the wash liquor is removed and sent to the recovery system. The remaining working fluid is removed via a drying gas. The vapors from the drying gas are condensed and the condensate is separated in step 250 into mostly aqueous working fluid, the first non-aqueous working fluid and the second non-aqueous working fluid.

Laundering fabric with water as the polar working fluid, removing a substantial portion of the water via centrifugation, contacting the fabric with dipropylene glycol n-butyl ether to provide additional cleaning of some hydrophobic soils as well as to remove some of the water that remains in the fabric, removing a substantial portion of the dipropylene glycol n-butyl ether, contacting the fabric with ethoxynonafluorobutane to remove a majority of the dipropylene glycol n-butyl ether and remaining water, centrifuging the fabric load, and then contacting the fabric with heated air to remove the remaining working fluids is a preferred embodiment. This particular method can take place in an apparatus designed for both aqueous and non-aqueous working fluid. In addition, due to the relative compatibility of the dipropylene glycol n-butyl ether, water and ethoxynonafluorobutane, a single plumbing system could be utilized.

Another preferred method includes laundering fabric with water as the polar working fluid, removing a substantial portion of the water via centrifugation, contacting the fabric with decamethylcyclopentasiloxane to provide additional cleaning of some hydrophobic soils as well as to remove some of the water that remains in the fabric, removing a substantial portion of the decamethylcyclopentasiloxane, contacting the fabric with ethoxynonafluorobutane to remove a majority of the decamethylcyclopentasiloxane and remaining water, centrifuging the fabric load, and then contacting the fabric with heated air to remove the remaining working fluids. In this system, due to the relative incompatibility of decamethylcyclopentasiloxane and water, separate aqueous and non-aqueous plumbing systems should be utilized in an apparatus designed to complete the aforementioned method.

In FIG. 4, the consumer selects a completely non-aqueous cycle, 260. In this instance, a non-aqueous working fluid is added, 262, to the container. The non-aqueous working fluid should have a surface tension less than 35 dynes/cm and preferably be non-flammable. More specifically the working fluid is selected from terpenes, halohydrocarbons, glycol ethers, polyols, ethers, esters of glycol ethers, esters of fatty acids and other long chain carboxylic acids, fatty alcohols and other long chain alcohols, short-chain alcohols, polar aprotic solvents, siloxanes, glycol ether acetates, hydrofluoroethers, dibasic esters, aliphatic hydrocarbons, carbon dioxide, ionic liquids and/or combinations thereof. Even more preferably, the working fluid is further selected from decamethylcyclopentasiloxane, dodecamethylpentasiloxane, octamethylcyclotetrasiloxane, decamethyltetrasiloxane, dipropylene glycol n-butyl ether (DPnB), dipropylene glycol n-propyl ether (DPnP), dipropylene glycol tertiary-butyl ether (DPtB), propylene glycol n-butyl ether (PnB), propylene glycol n-propyl ether (PnP), tripropylene methyl ether (TPM), i-propyl myristate, soy clear methyl esters, ethyl hexyl lactate, and/or combinations thereof.

At least one washing additive can be added to the non-aqueous working fluid. This additive can be similar or different than the additives mentioned above. The washing additive can be selected from the group consisting of: builders, surfactants, enzymes, bleach activators, bleach catalysts, bleach boosters, bleaches, alkalinity sources, antibacterial agents, colorants, perfumes, pro-perfumes, finishing aids, lime soap dispersants, composition malodor control agents, odor neutralizers, polymeric dye transfer inhibiting agents, crystal growth inhibitors, photobleaches, heavy metal ion sequestrants, anti-tarnishing agents, anti-microbial agents, anti-oxidants, linkers, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters, fabric softeners, antistatic agents, dye fixatives, dye abrasion inhibitors, anti-crocking agents, wrinkle reduction agents, wrinkle resistance agents, soil release polymers, soil repellency agents, sunscreen agents, anti-fade agents and mixtures thereof.

A similar or different non-aqueous fluid can be added in step 240. If the non-aqueous fluid added in step 260 is flammable, then it is preferred that the non-aqueous fluid in step 240 is non-flammable. In addition to non-flammability, other characteristics ideal for the non-aqueous fluid include but are not limited to: vapor pressure higher than the vapor pressure added in step 260, surface tension lower than the surface tension of the non-aqueous fluid in step 260 and Hansen Solubility parameters selected from the following criteria: a polarity greater than about 3 and hydrogen bonding less than 9; hydrogen bonding less than 13 and dispersion from about 14 to about 17; or hydrogen bonding from about 13 to about 19 and dispersion from about 14 to about 22. The only remaining step that differs from FIG. 2 is after condensing the working fluids, the working fluids are separated in step 266.

In almost every instance, the non-aqueous working fluids are more expensive than their aqueous counterparts. Therefore, minimizing non-aqueous working fluid is essential for apparatuses and methods involving these fluids. One potential method for minimizing fluid usage is through spray rinse or spray wash technology. Spray wash/rinse technology works by adding the non-aqueous working fluids while the drum is spinning at a force sufficient to move the fabrics toward the wall of the drum. This may occur at a force greater than 1 G. Generally this force is at a spinning speed of at least 50-rpm, more preferably greater than 100 rpm and most preferably greater than 200 rpm. The time required is dependent upon the application but should be greater than 30 seconds and shouldn't exceed 15 minutes. The amount of non-aqueous fluid required is to provide sufficient soil removal or sufficient removal of other working fluids. This amount should be less than 10 liters of non-aqueous fluid per kilogram of fabric, more preferably less than 5 liters per kilogram of fabric and most preferably less than 2 liters per kilogram of fabric.

FIG. 5 describes an embodiment utilizing a semi-aqueous wash. The consumer selects the semi-aqueous wash with fast dry cycle, 270. Next a mixed working fluid is added in step 272. The mixed fluid will be a portion of aqueous working fluid as well as non-aqueous working fluid. The purpose of the mixed fluid is to enhance the removal of oily soil without limiting the removal of the hydrophilic soil. The mixture can be favored toward aqueous working fluid or non-aqueous working fluid. The composition of aqueous working fluid should range from 0.05%-99.95% while the composition of non-aqueous working fluid should range from 0.05-99.95%. The ideal aqueous working fluid for this type of process has been described above as well as the non-aqueous working fluids best suited for this process. The one limitation placed on the non-aqueous fluid is that it should be able to hold at least 0.05% of an aqueous working fluid. The remaining part of the process is nearly identical to FIG. 4. A non-aqueous working fluid removes the mixed working fluid, followed by removal and drying processes.

Figure 6:
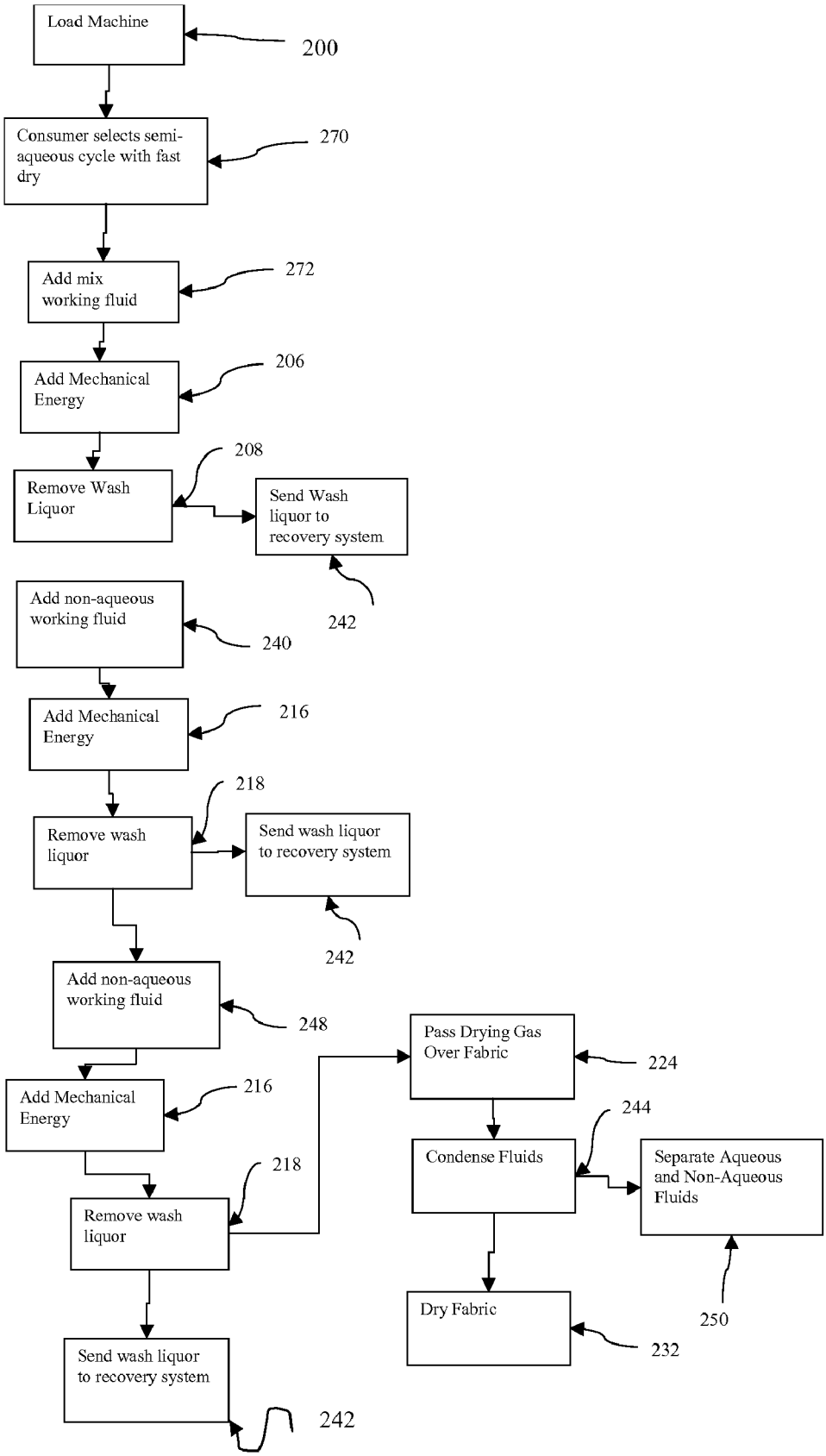
FIG. 6 depicts a flow diagram of a sixth embodiment of wash, rinse, dry, and recovery events that with material described make possible a laundering machine with an aqueous, semi-aqueous, and non-aqueous method.

FIG. 6 describes an embodiment similar to FIG. 5 in that a mixed working fluid is utilized to complete a semi-aqueous wash cycle. In this method, a non-aqueous working fluid is used to remove most of the mixed working fluid while an additional non-aqueous fluid can be added to improve the drying performance.

Figure 7:
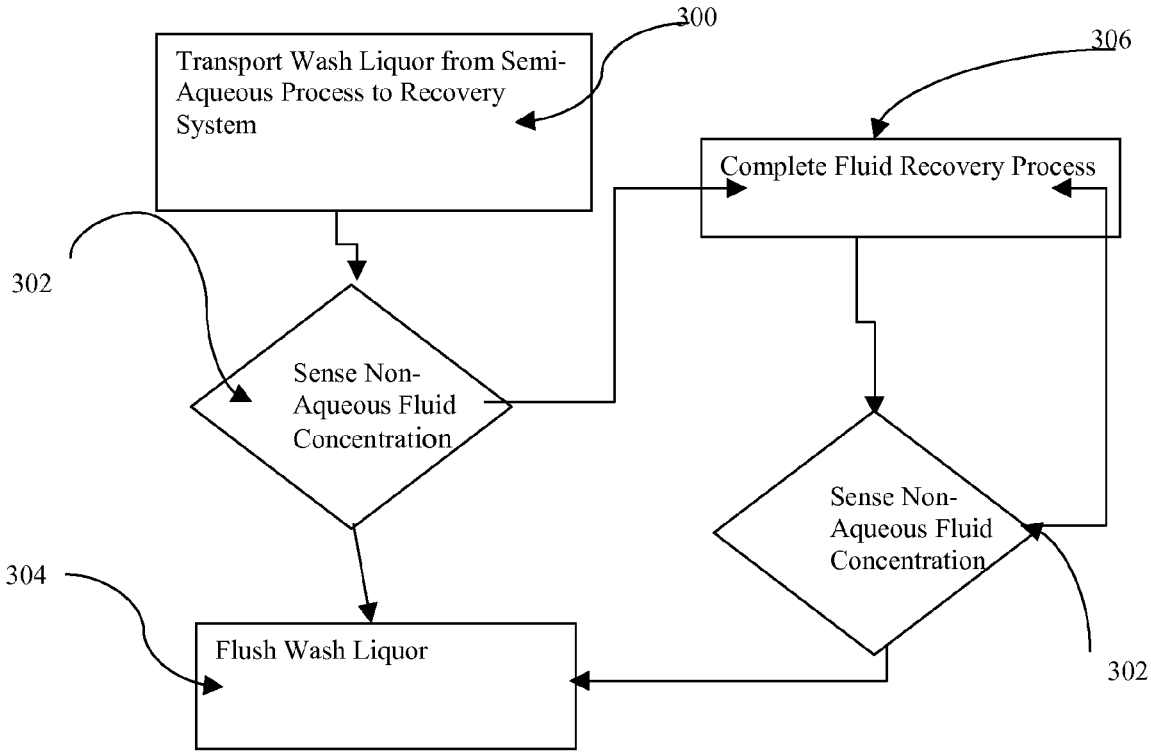
FIG. 7 depicts a flow diagram for one embodiment of the recovery process.

FIG. 7 describes another embodiment of the invention. In this case, wash liquor is transported from the semi-aqueous process to the recovery system in step 300. Step 302 represents a decision on whether an adequate concentration of non-aqueous fluid is present. Mechanisms to determine the adequate non-aqueous fluid concentration include, but are not limited to pressure, turbidity, conductivity, infrared, ultrasonic, shaped electromagnetic fields (SEF), float sensing, laser deflection, petrotape/chemtape, electric field imaging, capacitive, humidity, non-dispersive infrared, solid state, acoustic wave, metal oxide semiconductors, pH, ionic strength, oxidation reduction potential, refractive index, and mixtures thereof. One particular embodiment that could be utilized is a combination pressure to determine level, turbidity to determine soil concentration and conductivity to determine water concentration. An algorithm can be designed to estimate the non-aqueous concentrations from these measurements. The decision in step 302 represents a method to potentially dispose of the waste/contaminants down the drain. If the non-aqueous fluid concentration exceeds the acceptable disposal limit, then a fluid recovery process, 306, is completed. If not, then the wash liquor is flushed in 304. If after one cycle, the concentration of the non-aqueous fluid still is not lower than that specified by the decision matrix, additional recovery cycles can be completed. Concentration limits that may be acceptable depend on the working fluid choices and the Environmental Protection Association (EPA) should set guidelines. Disposing the contaminants is always completed in an environmentally friendly manner. It is preferred that the non-aqueous fluid concentration does not exceed 2% per liter of fluid, more preferably less than 1000 g/liter and most preferably less than 100 g/liter. These numbers are true if the waste is disposed down the drain. If the waste will be sent to a filter for landfill disposal, the numbers will change.

Figure 8:
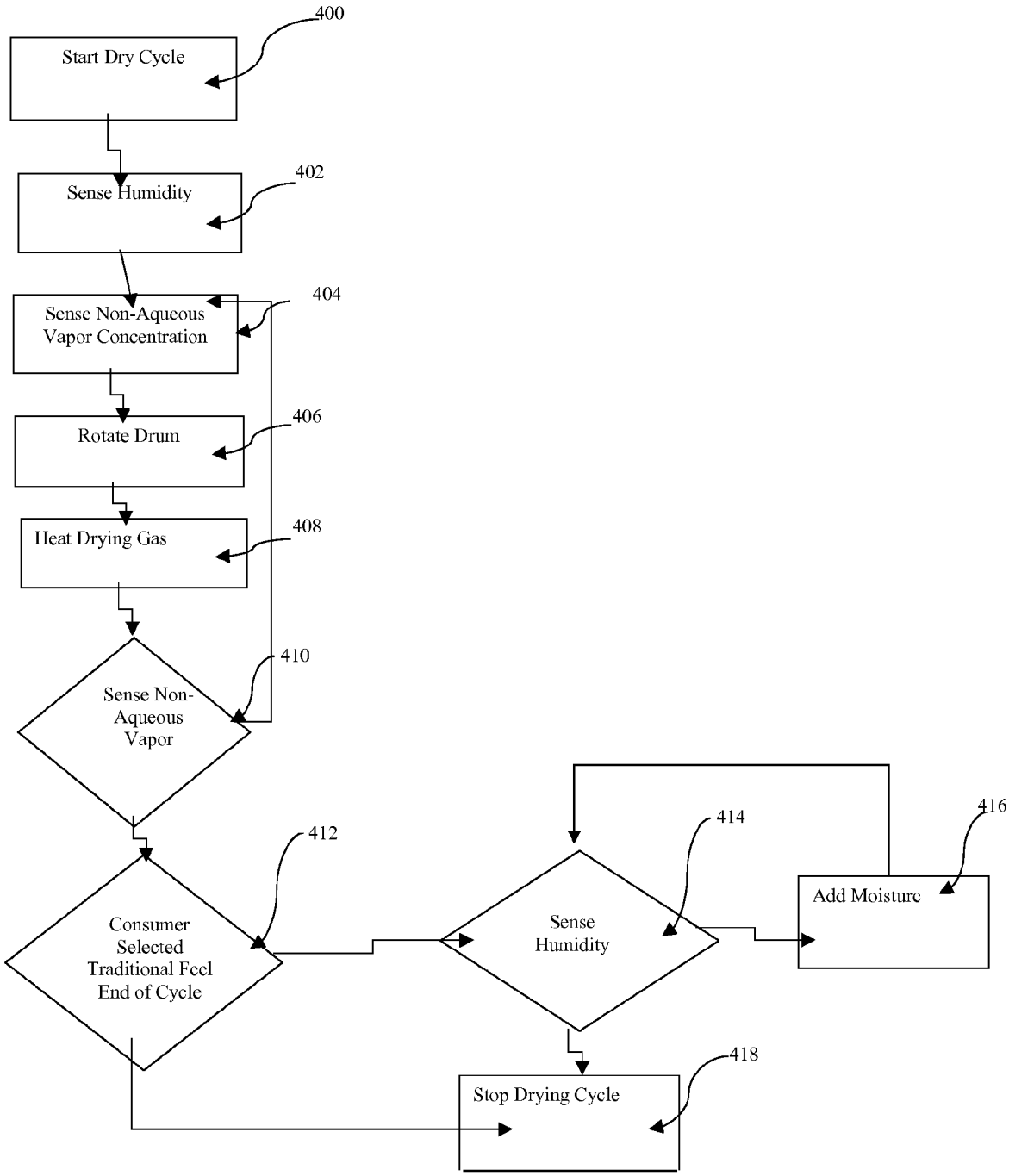
FIG. 8 depicts a flow diagram for one embodiment of the drying process.

FIG. 8 represents a method of drying. The drying cycle is started in 400. The humidity of the load is checked in 402. The purpose of checking the humidity is to determine the water content in the air stream and the fabric load and using this information to determine moisture content or to control temperature spikes as the water is removed. Methods of sensing the humidity include but are not limited to conductivity, humidity strips, thermisters, infrared, pressure, refractive index, and mixtures thereof. The non-aqueous fluid concentration is sensed in 404. This is done to understand if non-aqueous vapor is already in the drying gas stream, to determine the amount of drying time necessary and to potentially help control the temperature in the system. Methods of sensing the non-aqueous fluid concentration were disclosed above. The drum is rotated in step 406. The drum may be rotated clockwise, counter-clockwise and/or a combination of both. The drum may be rotated at different tumbling speeds and the tumbling speeds can vary as a function of the dryness of the fabric load. The drying gas is heated in step 408 and forced through and around the fabric load. As the drying proceeds, the non-aqueous vapor concentration is continuously monitored, 410. If the non-aqueous vapor concentration is lower than a set value, then step 412 can take place. Otherwise the drum and drying gas is continuously rotating and passing over and through the fabric load. The non-aqueous vapor concentration should reach a concentration lower than 5% by mass of the fabric load, preferably less than 2% and most preferably less than 1%. In traditional aqueous drying process, the drying process is complete when 4-5% of moisture remains in the fabric load and in some instances less than 8%. In non-aqueous systems, it is nearly imperative to remove all of the non-aqueous vapor from the fabric load. This gives nearly a bone-dry condition. In the traditional drying process, this moisture remaining represents the traditional hand/feel most consumers expect from their drying process. Step 412 represents a decision of giving the consumer the opportunity to add the traditional hand/feel to the garment. If the consumer so desires, water vapor may be added to the drying system. This process occurs by sensing the humidity in step 414. If the moisture content is not within the correct range (preferably 2-8%, more preferably 3-6% and most preferably 4-5%), then moisture is added, 416. Once the concentration is reached, the drying cycle is stopped in 418. It should be noted that a timed-drying cycle is also possible; however, the consumer will not have access to the fabric load until an acceptable non-aqueous fluid concentration has been achieved.

Figure 9:
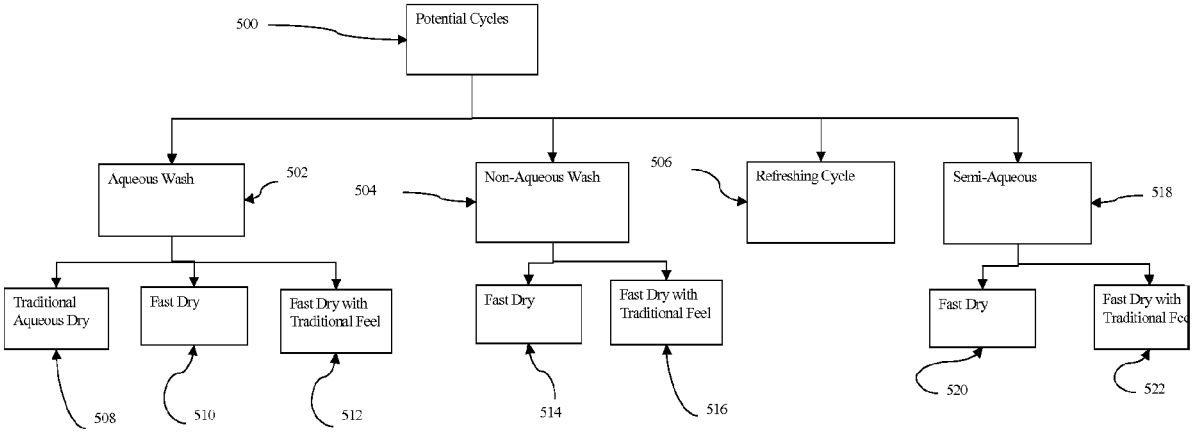
FIG. 9 depicts a flow diagram for some of the cycles possible.

As has been mentioned throughout the specification, there are many potential cycles, 500, that can be utilized by the consumer. FIG. 9 represents some of these cycles. Some of the cycle choices are described below but the specification is not meant to describe all the cycle choices. The consumer can select between an aqueous wash (502), non-aqueous wash (504), refreshing cycle (506) or semi-aqueous wash (518). The refreshing cycle has not been described in this specification, but would utilize a non-aqueous working fluid described above for less than a 30-minute cycle to remove odors and remove wrinkles. With the aqueous wash, the consumer can select a traditional aqueous dry, 508, which would be the longest cycle time and most energy intensive, a fast dry, 510, with a non-aqueous working fluid as described in FIGS. 2 and 3 or a fast dry with a traditional hand/feel, 512, which was described briefly by FIG. 8. When selecting a non-aqueous wash, the consumer can select a fast dry, 514, which represent drying with a non-aqueous fluid as described in FIG. 4 or a fast dry with traditional hand/feel, 516. When selecting a semi-aqueous wash, the consumer has the options of a fast dry, 520, as represented by FIGS. 5 and 6 and with a non-aqueous fluid or fast dry with a traditional hand/feel, 522.

Figure 10:
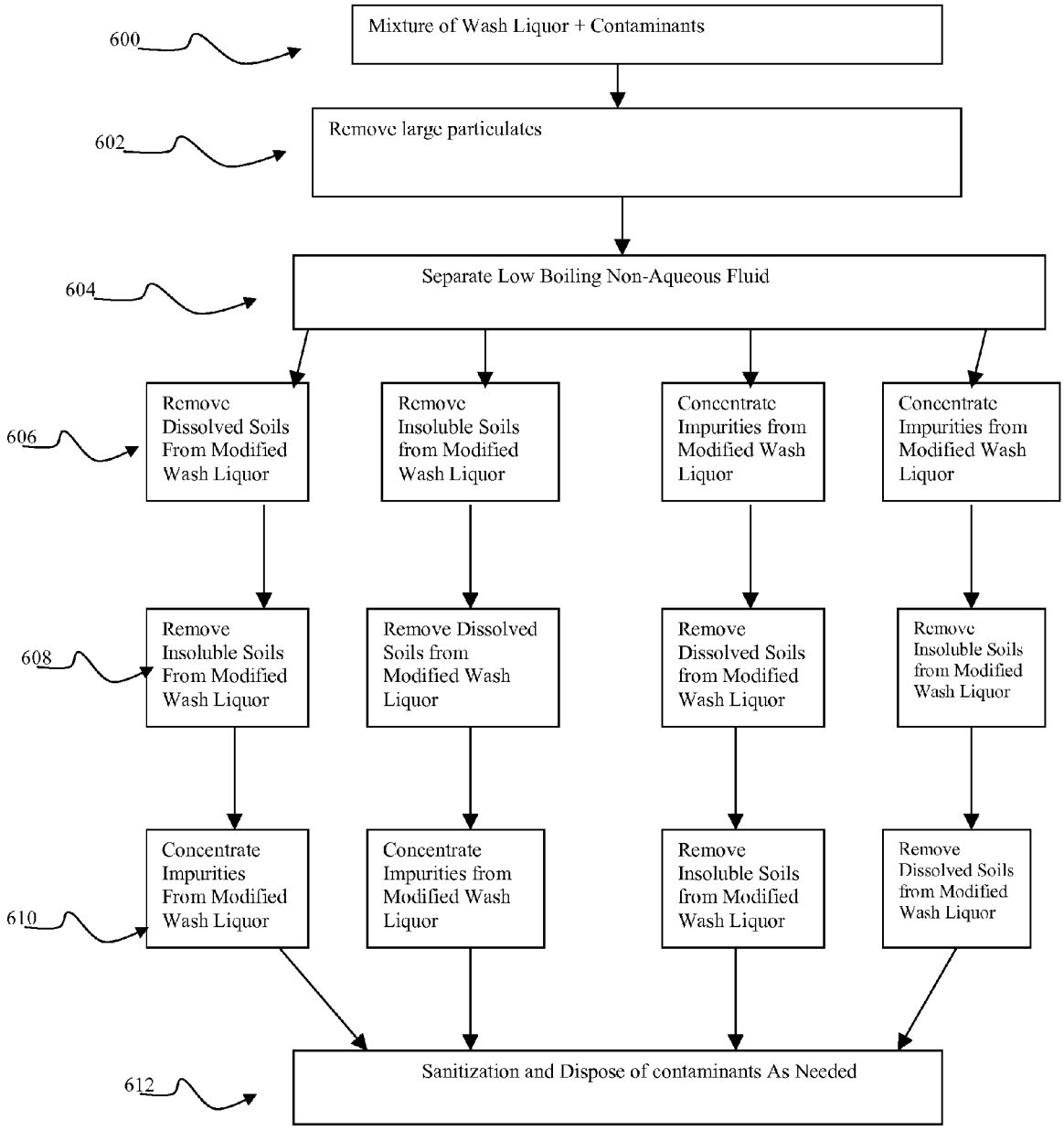
FIG. 10 represents potential recovery methods for a system containing a non-aqueous fluid in the absence of an aqueous working fluid.

FIG. 10 shows other embodiments of the invention generally related to recovery. Although not shown, any loop or path may be repeated. In addition, it should be recognized that any step might be combined with another step or omitted entirely. The mixture of wash liquor and contaminants are introduced to the recovery system in step 600. This recovery process is only defined for non-aqueous fluid containing processes. FIG. 10 depicts an embodiments wherein one of the initial steps in the recovery process is to remove large particulates 602. As mentioned herein, any mode of large particulate removal is contemplated, including using the coarse lint filter, filtration, and other separation techniques. Large particulates can be buttons, lint, paper clips, etc., such as those having a size of greater than 50 microns. Small particulates may be less than 50 microns. A method of particulate removal may include a dehydration step in the wash chamber by heating the fabrics so that any residual water is removed. By doing so, the electrostatic bond between the dirt and fabric is broken, thereby liberating the dirt. This dirt can then be removed. Other methods of particulate removal include but are not limited to vortex separation, flotation, solidification, centrifugation, electrostatic (phoresis), ultrasonic, gas bubbling, high performance liquid chromatography and chemical digestion.

The materials having a low boiling point solvent (i.e. less than 100° C.) are separated and recovered in step 604. Methods for separating the low boiling point non-aqueous fluids from the wash liquor include, but are not limited to: fractional distillation, temperature reduction, addition of a flocculating agent, adsorption/absorption, liquid extraction through the use of another additive, filtration, gravimetric separation, osmosis, evaporation, pervaporation, pressure increase, ion exchange resin, chemisorption, single stage distillation, multiple stage distillation or a combination of the aforementioned steps. The final low boiling non-aqueous fluid that is recovered and stored for reuse should contain less than 50% by weight impurities including other working fluids, more preferably less than 25% and most preferably less than 10%.

Dissolved soils include those items that are dissolved in the working fluid, such as oils, surfactants, detergents, etc. Mechanical and chemical methods or both may remove dissolved soils 606. Mechanical removal includes the use of filters or membranes, such as nano-filtration, ultra-filtration and microfiltration, and/or cross flow membranes. Pervaporation may also be used. Pervaporation is a process in which a liquid stream containing two or more components is placed in contact with one side of a non-porous polymeric membrane while a vacuum or gas purge is applied to the other side. The components in the liquid stream sorb into the membrane, permeate through the membrane, and evaporate into the vapor phase (hence the word pervaporate). The vapor, referred to as "the permeate", is then condensed. Due to different species in the feed mixture having different affinities for the membrane and different diffusion rates through the membrane, a component at low concentration in the feed can be highly enriched in the permeate. Further, the permeate composition may differ widely from that of the vapor evolved in a free vapor-liquid equilibrium process. Concentration factors range from the single digits to over 1,000, depending on the compounds, the membrane and process conditions.

Chemical separation may include change of state methods, such as temperature reduction (e.g., freeze distillation), temperature increase, pressure increase, flocculation, pH changes and ion exchange resins.

Other removal methods include electric coalescence, absorption, adsorption, endothermic reactions, temperature stratification, third component addition, dielectrophoresis, high performance liquid chromatography, ultrasonic, and thermo-acoustic cooling techniques.

Insoluble soils 608 may include water, enzymes, hydrophilic soils, salts, etc. Items may be initially insoluble but may become soluble (or vice versa) during the wash and recovery processes. For example, adding dissolvers, emulsifiers, soaps, pH shifters, flocculants, etc., may change the characteristic of the item. Other methods of insoluble soil removal include filtration, caking/drying, gravimetric, vortex separation, distillation, freeze distillation and the like.

The step of concentrating impurities 610 may include any of the above steps done that are done to reduce, and thereby purify, the working fluid recovery. Concentrating impurities may involve the use of multiple separation techniques or separation additives to assist in reclamation. It may also involve the use of a specific separation technique that cannot be done until other components are removed.

In some instances, the surfactants may need to be recovered. A potential means for recovering surfactants is through any of the above-mentioned separation techniques and the use of $CO_2$ and pressure.

As used herein, the sanitization step 612 will include the generic principle of attempting to keep the unit relatively clean, sanitary, disinfected, and/or sterile from infectious, pathogenic, pyrogenic, etc. substances. Potentially harmful substances may reside in the unit due to a prior introduction from the fabrics cleaned, or from any other new substance inadvertently added. Because of the desire to retrieve clean clothes from the unit after the cycles are over, the amount of contamination remaining in the clothes ought to be minimized. Accordingly, sanitization may occur due to features inherent in the unit, process steps, or sanitizing agents added. General sanitization techniques include: the addition of glutaraldehyde tanning, silver, formaldehyde tanning at acidic pH, propylene oxide or ethylene oxide treatment, gas plasma sterilization, gamma radiation, electron beam, ultraviolet radiation, peracetic acid sterilization, thermal (heat or cold), chemical (antibiotics, microcides, cations, etc.), and mechanical (acoustic energy, structural disruption, filtration, etc.).

Sanitization can also be achieved by constructing conduits, tanks, pumps, or the like with materials that confer sanitization. For example, these components may be constructed and coated with various chemicals, such as antibiotics, microcides, biocides, enzymes, detergents, oxidizing agents, etc. Coating technology is readily available from catheter medical device coating technology. As such, as fluids are moving through the component, the fluids are in contact with the inner surfaces of the component and the coatings and thereby achieve contact-based sanitization. For tanks, the inner surfaces of tanks may be provided with the same types of coatings thereby providing longer exposure of the coating to the fluid because of the extended storage times. Any coating may also permit elution of a sanitizer into the fluid stream. Drug eluting stent technology may be adapted to permit elution of a sanitizer, e.g., elution via a parylene coating.

Figure 11:
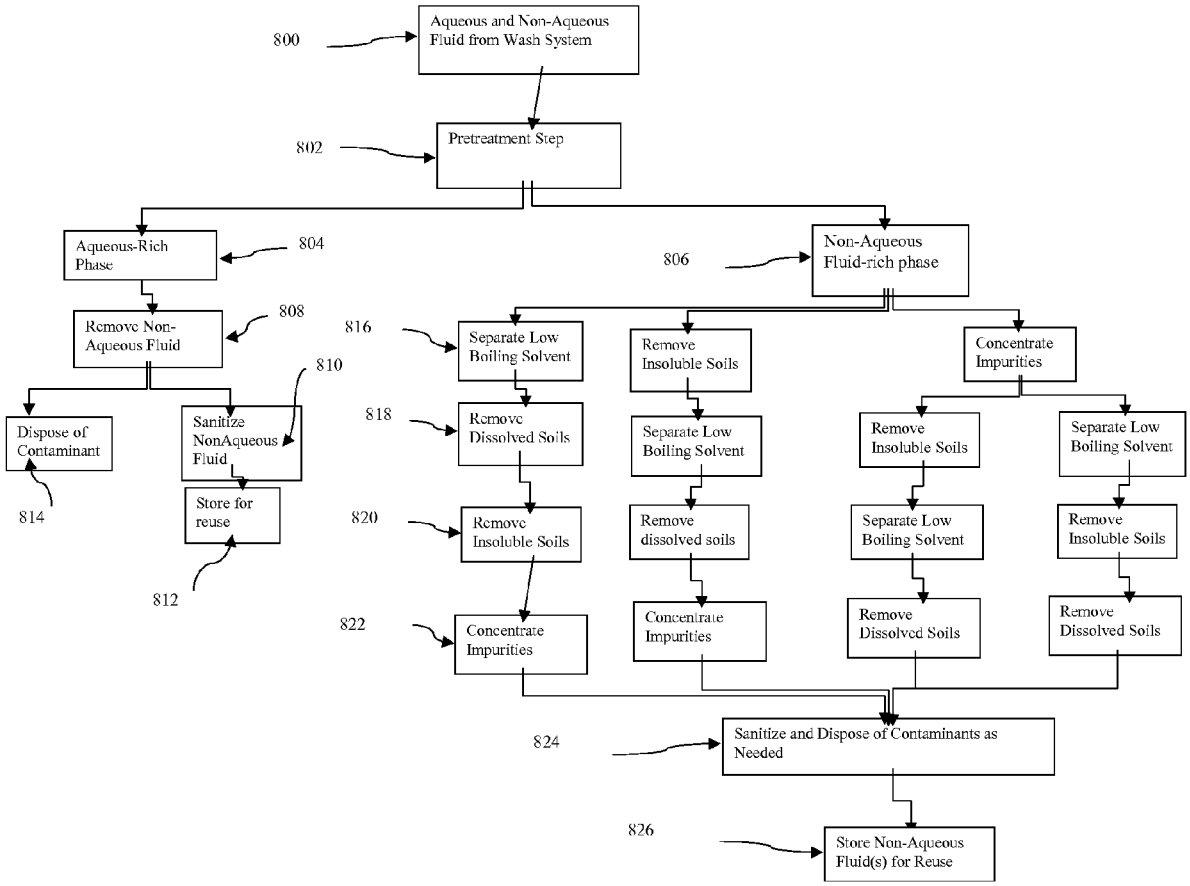
FIG. 11 represents potential recovery methods for a system containing an aqueous working fluid for cleaning and non-aqueous working fluid for drying.

FIG. 11 describes an embodiment of the recovery system. The aqueous and non-aqueous fluid containing wash liquor is received from the wash system in 800. The first step is pretreating, 802, the mixture. The pretreatment step can be a single step or a series of unit operations. The objective of the pretreatment step is to divide the mixture into the aqueous-rich phase, 804, and non-aqueous rich phases, 806, and concentrate as much of the respective working fluids in their phase. Some unit operations that are applicable as a pretreatment step include but are not limited to liquid extraction with one or more solutes, temperature shifts, pervaporation, pressure shifts, adsorption, absorption, filtration, flocculation, evaporation, chemisorption, osmosis, ion exchange resins, gravimetric, endothermic/exothermic reactions, or combinations thereof. In the aqueous-rich phase, the next step is to remove the non-aqueous fluid, 808, that remains. Methods of removing the non-aqueous fluid include but are not limited to distillation (single and multi-stage), filtration, adsorption, absorption, temperature reduction, flocculation, ion exchange resins, chemisorption, endothermic/exothermic reactions, pervaporation, osmosis, gravimetric, pressure shifts, pH shifts, and/or combinations thereof. The aqueous working fluid and contaminants remaining are then prepared for disposal, 814. The non-aqueous fluid removed in 808 is then sanitized, 810, by methods described above. The non-aqueous fluids are then stored for reuse, 812.

The non-aqueous fluid-rich phase, 806, are treated in a similar manner as described in FIG. 10. The low boiling point solvents are separated, 816, the dissolved soils are removed, 818, the insoluble soils are removed, 820, the impurities are concentrated, 822, the fluids are sanitized, 824, and the contaminants are diposed, 826 and finally the liquids are stored for reuse, 826. Different configurations are detailed in FIG. 11.

Figure 12:
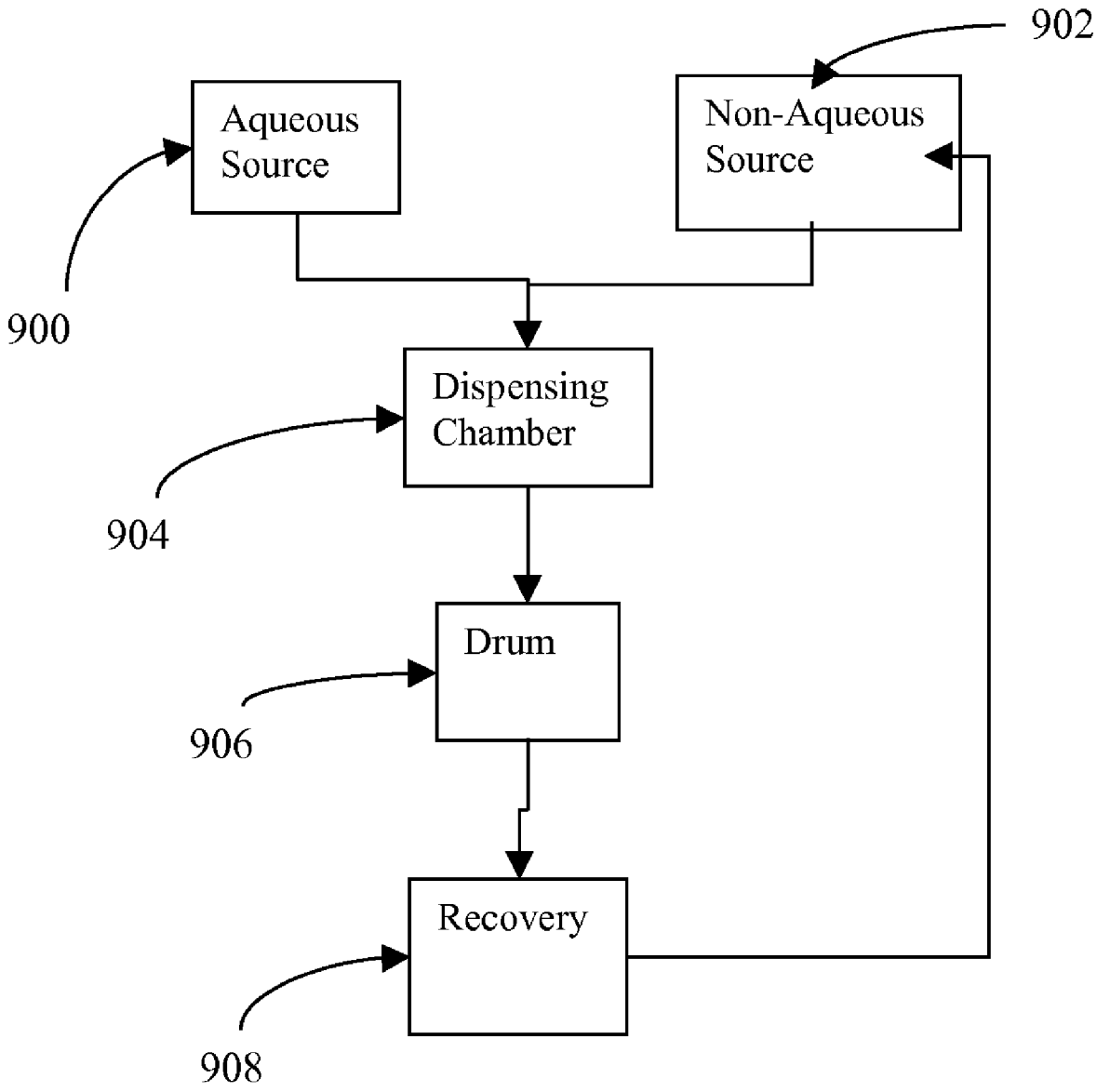
FIG. 12 represents a plumbing system for such an apparatus capable of handling both aqueous and non-aqueous working fluids.

FIG. 12 depicts a plumbing system for an apparatus that is capable of aqueous and non-aqueous laundering from the aforementioned methods. The aqueous working fluid is delivered to the system via an aqueous source, 900. This aqueous source could be residential water supply lines or from a tank contained within the apparatus. At least one non-aqueous source, 902, delivers the non-aqueous working fluid to the system. This non-aqueous source is from tanks, reservoirs, cartridges, etc and such materials of construction should be compatible with the non-aqueous working fluids. Both the aqueous and non-aqueous sources are plumbed separately and are directed toward a dispensing chamber, 904. This dispensing chamber may house one or more units to dispense additives for each working fluid identified. After the dispensing chamber, the remaining part of the wash, recirculation and drying loops are single plumbed conduit lines. From the dispensing chambers, the working fluids are routed through the drum, 906. Inside the drum, the laundering process will be completed and it should be noted that the sump, drain pump, fill-pumps, button traps, valving, etc are including within the scope of the drum Finally, after the process is complete, the recovery system, 908, reclaims the non-aqueous working fluids and returns the working fluid to its source and the contaminants removed are then disposed of in some manner.

It should be understood that lines could be single plumbed conduits and contain multiple coaxial lines within or a device for cleaning out a substantial portion of the working fluid to prevent cross contamination. Such lines make it possible for incompatible aqueous and non-aqueous fluids to be utilized within a single line plumbed apparatus.

It should be understood that fabric enhancement chemistries could be added at any time throughout the process. Some potential chemistries include but are not limited to: fabric softeners, viscosity thinning agents such as cationic surfactants, soil repellency agents, fabric stiffening agents, surface tension reducing agents and anti-static agents.

In some instances the working fluids are immiscible and the miscibility gap could be overcome by a change in temperature or the addition of one or more components.

In any of the aforementioned figures, heating may be supplied at any time to heat the machine, one or more machine components, the fluids, the fabric, air or a combination thereof.

In general, fabrics have a tendency to be damaged by temperatures exceeding 60° C. and most inlet air temperatures in traditional dryers may exceed 175° C. In traditional non-aqueous systems, the working fluids of choice usually have flashpoints lower than 100° C. In addition to the high flash points, these working fluids have low vapor pressures and they require higher temperatures for removal from the fabric. The National Fire Protection Association regulates the temperatures to which these working fluids may be heated to 30° F. below the flash point of the solvent.

A non-flammable fluid combined with a flammable fluid increases the flash point of the solvent; thereby, increasing the safety associated with the system. The non-flammable, non-aqueous working fluid will volatilize more quickly creating a non-flammable-rich headspace above the working fluid; and this greatly reduces fire and explosion hazards due to the wash medium used. While most of the existing codes are set only for commercial machines, the ability to use this apparatus and method in the home can be more easily adapted with the preferred rinse fluid method. The method has the capabilities of mitigating the risk associated with the use of cleaning with a flammable solvent.

The preferred apparatus for such an operation should contain a myriad of components and can be modular in nature if need be and has already been disclosed in patent application Ser. No. 10/971,671 which is included herein for reference. The apparatus should contain storage containers for the working fluid(s) as well as rinse fluid(s). The apparatus should contain a drum or container for depositing clothes a means for controlling the drum such as a motor, a means for dispensing the working fluids, washing additives and the likes into the wash chamber, a blower to move air for drying, a heating means for heating the air, the fluids, the fabrics or the drum, a condensing means to remove the solvent vapors from the air stream, a means to add mechanical energy to the drum, means for sensing, a means for recovery and a control means.

In a preferred embodiment, the apparatus would be constructed in a manner where the size wouldn't require modifications to place the unit within the home.

One of the main benefits in addition to drying time that resulted from an aqueous working fluid with a non-aqueous working fluid is low energy consumption. Aqueous working fluids generally have high heat capacity and hydrogen bond to the fabric load requiring excessive energy to be removed from the fabric load. On the other hand, non-aqueous working fluids have lower specific heats, lower heat capacity and don't hydrogen bond to the fabric lower thereby lowering the energy required for removal from the fabric load.

It should be noted that even though some of the figures show a horizontal axis fabric care machine, all of the described inventions above can be completed in a vertical axis machine, a cabinet apparatus, or any other apparati that can complete fabric cleaning or other substrate cleaning apparati such as hard surface cleaners.

In some instances, thermal management may be very effective in such a process. The motors turning the drum and operating the pump traditionally give off heat. This heat may be effectively used in heating the non-aqueous fluid for drying, spinning and/or heating the rinse fluid to promote increased cleaning. Additionally, some type of cooling mechanism is a preferred embodiment to the reclamation system and this cooling system can be interspersed throughout the product to provide more energy efficient heating and cooling.

It should also be noted that a machine of this kind would be new to the world and methods for selling, installing, servicing and marketing would need to be further described. An example would be a method of marketing fabric care material for use in conjunction with a laundry machine capable of utilizing an aqueous, semi-aqueous and/or non-aqueous working fluid comprising the steps of: identifying the desired consumer benefits; selecting a material to respond the consumer benefit; and optionally, distributing the fabric care material to a vendor. The fabric care materials can be combined and sold in kits and instructions for use can be provided. Selling such a machine may require professional installation and professional servicing as well.

We claim:

1. A method for laundering fabric in a laundering apparatus comprising:
- disposing a fabric load in a container;
- washing the fabric with a wash fluid comprising a non-aqueous working fluid;
- removing the wash fluid after washing;
- drying the fabric load after removing the wash fluid from the container, the drying comprising:
  - flowing drying gas through the container to dry the fabric load;
  - sensing a non-aqueous working fluid concentration in the fabric while flowing the drying gas through the container;
  - sensing the moisture concentration in the fabric while flowing the drying gas through the container;
  - determining whether the non-aqueous working fluid concentration is less than about 5% by mass of fabric and determining whether the moisture concentration is less than about 4% by mass of the fabric, and
  - adding additional moisture to the fabric when it is determined that the non-aqueous fluid concentration is less than about 5% by mass of fabric and it is also determined that the moisture concentration is less than about 4% by mass of fabric.

2. The method of claim 1, wherein the moisture is added such that the amount of moisture in the fabric ranges from about 4% to about 8% by mass of the fabric.

3. The method of claim 1, wherein the adding the additional moisture to the fabric occurs when it is determined that the non-aqueous fluid concentration is less than about 2% by mass of fabric, and it is determined that the moisture concentration is less than about 4% by mass of fabric.

4. The method of claim 1, wherein the moisture is added such that the amount of moisture in the fabric ranges from about 4% to about 5% by mass of the fabric.

5. The method of claim 1, wherein said adding moisture comprises at least one of: utilizing a spraying nozzle, utilizing a misting nozzle, and exposing the fabric to air that is external to the container.

6. A method for laundering fabric in a laundering apparatus comprising:
- disposing a fabric load in a container;
- washing the fabric with a wash fluid comprising a non-aqueous working fluid;
- removing the wash fluid after washing;
- drying the fabric load after removing the wash fluid from the container, the drying comprising:
  - flowing drying gas through the container to dry the fabric;

sensing a non-aqueous working fluid concentration in the fabric while flowing the drying gas through the container;

sensing the moisture concentration in the fabric while flowing the drying gas through the container;

determining whether the non-aqueous working fluid concentration is less than about 5% by mass of fabric, and adding additional moisture to the fabric when it is determined that the non-aqueous fluid concentration is less than about 5% by mass of fabric, and wherein the additional moisture is added such that the amount of moisture in the fabric ranges from about 2% to about 8% by mass of the fabric.

7. The method of claim 1, wherein the adding the additional moisture to the fabric occurs when it is determined that the non-aqueous fluid concentration is less than about 1% by mass of fabric, and it is determined that the moisture concentration is less than about 4% by mass of fabric.

8. The method of claim 1, wherein the adding the additional moisture to the fabric occurs when it is determined that the non-aqueous fluid concentration is less than about 5% by mass of fabric, and it is determined that the moisture concentration is less than about 3% by mass of fabric.

9. The method of claim 8, wherein the moisture is added such that the amount of moisture in the fabric ranges from about 3% to about 6% by mass of the fabric.

10. The method of claim 1, wherein the adding the additional moisture to the fabric occurs when it is determined that the non-aqueous fluid concentration is less than about 5% by mass of fabric and if the it is determined that the moisture concentration is less than about 2% by mass of fabric.

11. The method of claim 10, wherein the moisture is added such that the amount of moisture in the fabric ranges from about 2% to about 8% by mass of the fabric.

12. The method of claim 1, wherein said adding moisture comprises at least one of utilizing a spraying nozzle and utilizing a misting nozzle.

13. The method of claim 1, wherein said sensing non-aqueous working fluid concentration comprises a sensing technique selected from the group of: pressure, turbidity, conductivity, infrared, ultrasonic, shaped electromagnetic fields (SEF), float sensing, laser deflection, petrotape/chemtape, electric field imaging, capacitive, humidity, non-dispersive infrared, solid state, acoustic wave, metal oxide semiconductors, pH, ionic strength, oxidation reduction potential, refractive index, and combinations thereof.

14. The method of claim 1, wherein the sensing moisture concentration comprises a sensing technique selected from the group of: conductivity, humidity strips, thermisters, infrared, pressure, refractive index, and combinations thereof.

15. The method of claim 1, wherein the sensing moisture concentration comprises a sensing technique that measures conductivity.

16. The method of claim 6, wherein the sensing moisture concentration comprises a sensing technique selected from the group of: conductivity, humidity strips, thermisters, infrared, pressure, refractive index, and combinations thereof.

17. The method of claim 6, wherein the additional moisture is added such that the amount of moisture in the fabric ranges from about 3% to about 6% by mass of the fabric.

18. The method of claim 6, wherein the additional moisture is added such that the amount of moisture in the fabric ranges from about 2% to about 8% by mass of the fabric.

19. The method of claim 6, wherein the adding the additional moisture to the fabric occurs when it is determined that the non-aqueous fluid concentration is less than about 2% by mass of fabric.

20. The method of claim 6, wherein the adding the additional moisture to the fabric occurs when it is determined that the non-aqueous fluid concentration is less than about 1% by mass of fabric.

* * * * *